United States Patent [19]

Coronado

[11] Patent Number: 5,020,600

[45] Date of Patent: Jun. 4, 1991

[54] METHOD AND APPARATUS FOR CHEMICAL TREATMENT OF SUBTERRANEAN WELL BORES

[75] Inventor: Martin P. Coronado, Houston, Tex.

[73] Assignee: Baker Hughes Incorporated, Houston, Tex.

[21] Appl. No.: 345,343

[22] Filed: Apr. 28, 1989

[51] Int. Cl.[5] ..... E21B 33/127; E21B 34/10

[52] U.S. Cl. ..... 166/387; 166/187; 166/329

[58] Field of Search ..... 166/387, 279, 305.1, 166/374, 386, 184, 185, 186, 187, 191, 319, 321, 323, 329, 318, 325, 328, 327; 251/58, 117, 175, 337

[56] References Cited

U.S. PATENT DOCUMENTS

| | | | |
|---|---|---|---|
| 4,648,448 | 3/1987 | Sanford et al. | 166/191 |
| 4,805,699 | 2/1989 | Halbardier | 166/182 |
| 4,815,538 | 3/1989 | Burroughs | 166/187 |

FOREIGN PATENT DOCUMENTS 2168734A 6/1986 United Kingdom .

OTHER PUBLICATIONS

Sales Brochure by TAM International, dated Jan. 1986, and entitled TAM-J Inflatable Workover/Testing Packers etc.

*Primary Examiner*—Ramon S. Britts
*Assistant Examiner*—Terry L. Melius
*Attorney, Agent, or Firm*—Jackson & Walker

[57] ABSTRACT

An apparatus for effecting chemical treatment of any selected portion of a subterranean well bore comprises a pair of vertically spaced, inflatable packing elements which are run into the well on a fluid conduit, such as continuous tubing. The apparatus permits circulation while being run into the well bore and, when positioned at a desired location, effects the expansion of the two inflatable elements by pressured fluid introduced through the supporting fluid conduit. The applied pressure is trapped within the inflatable elements by axial movement of an inner body assemblage of the apparatus relative to an outer body assemblage, which is opposed by a spring. The relative movement effects the opening of fluid communication between the central fluid conduit and the wall bore portion between the inflated packing elements, permitting testing of the sealing effectiveness of the packing elements, and the application of a treatment fluid. The same movement, accompanied by an increase in fluid pressure supplied through the fluid supply conduit, effects the opening of a fluid path to the well bore above the uppermost packing element. The pressurizing and/or testing fluid remaining in the fluid supply conduit may be discharged into the well annulus by supplying pressurized treatment fluid through the supply conduit. For deflation of the inflatable packing elements, the central body is moved downwardly by the spring, a circulation port is opened and a rupture disc is ruptured through the application of preselected higher fluid pressures, thus permitting drainage of fluid from the inflatable elements and circulation as the tool is withdrawn from the well.

45 Claims, 10 Drawing Sheets

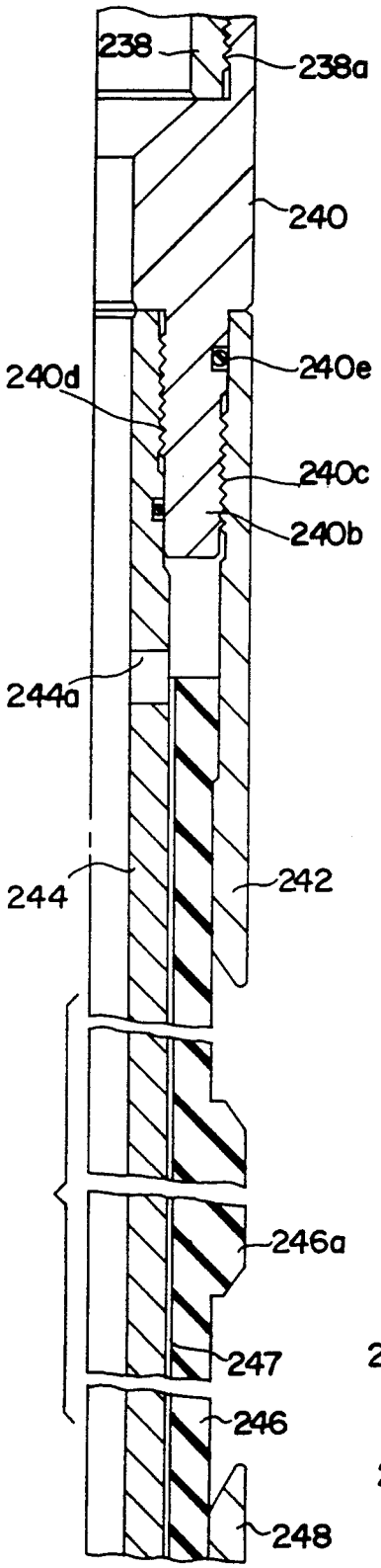
FIG.IJ
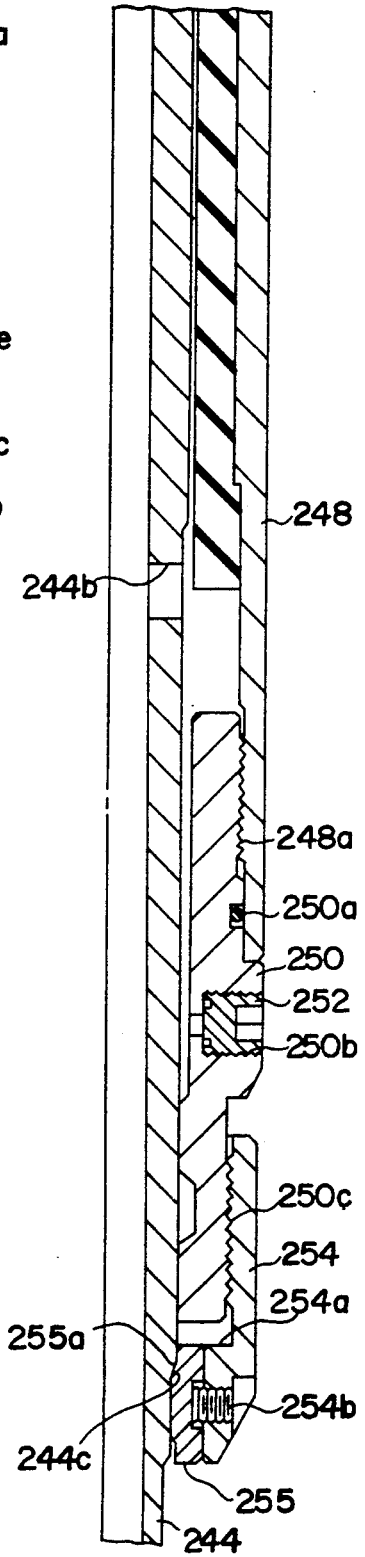
FIG.IK
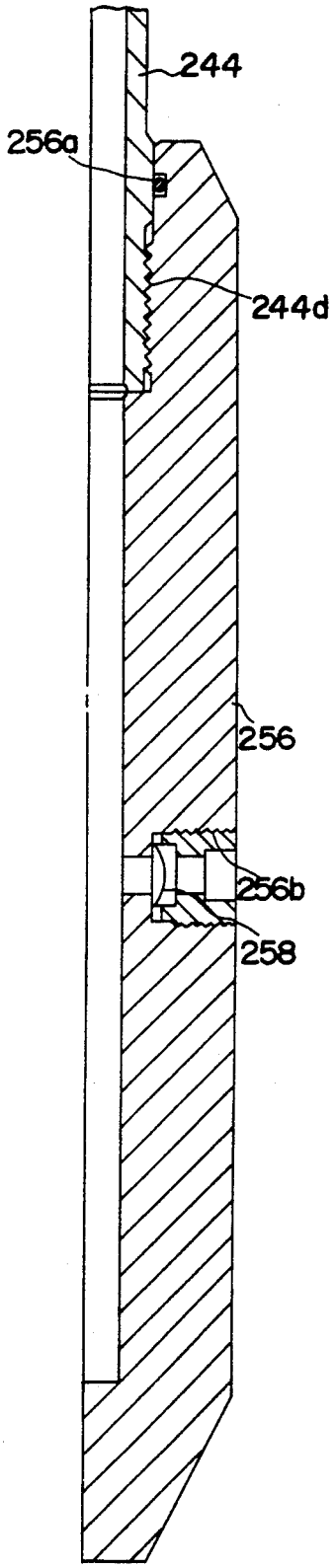
FIG.IL

METHOD AND APPARATUS FOR CHEMICAL TREATMENT OF SUBTERRANEAN WELL BORES

BACKGROUND OF THE INVENTION

1. Field of the Invention

The invention relates to an apparatus for chemical treatment of any selected portion of a subterranean well bore through the employment of two vertically spaced, inflatable packing elements. 2. Summary of the Prior Art Vertically spaced, inflatable packing elements have been widely used to isolate a selected portion of a well bore for chemical treatment. Prior art apparatus for achieved circulation while the treatment apparatus was being run into the well by passing the circulation fluid through the entire tool. See U.S. Pat. No. 4,708,208. Furthermore, the required manipulation of valves in prior art treatment apparatus have generally required the utilization of set down weight. This renders impractical the use of coiled tubing as the fluid supply conduit upon which the treatment apparatus is run into the well, since coiled tubing cannot apply any significant amount of set down weight.

It is also highly desirable that the portion of the well bore to be chemically treated not be saturated with fluids employed to affect the inflation or testing of the inflatable packing elements. In prior art apparatus, all of such setting and/or testing fluids contained in the coiled tubing were injected into the isolated well bore portion prior to the chemical treatment fluid ever reaching such portion. This, of course, is highly undesirable.

Lastly, prior art well treatment apparatus embodying a pair of vertically spaced, inflatable elements have not been designed so as to permit circulation during the retrieval of the entire apparatus from the well. There is a definitive need, therefore, for a well treatment apparatus employing axially spaced, inflatable packing elements that can be run into the well on an auxiliary tool, such as coiled tubing inserted through a pre-existing tubing string and is capable of performing all of the desirable functions, such as circulation during run-in, testing of the tool's pressure integrity after inflation of the packing elements, removal of the inflation and/or testing fluid from the tubing by forcing such fluid into a well bore above the uppermost inflatable element prior to initiating the introduction of chemical treatment fluid into the isolated portion of the well bore, deflation without set down weight to permit the inflatable packing elements to be repeatedly repositioned in the well bore, and lastly, provision for circulating while retrieving the treatment apparatus from the well bore.

BRIEF DESCRIPTION OF INVENTION

A primary object of this invention is to provide an apparatus capable of fulfilling all the above mentioned deficiencies of prior art apparatus. A well bore treatment apparatus embodying this invention has a central tubular body assemblage which is connectable at its upper end to a fluid supply conduit, such as coiled tubing. The lower portions of the central tubular body assemblage is surrounded by an outer tubular body assemblage which incorporates two axially spaced, inflatable packing elements formed of elastomeric material. The central tubular body assemblage defines a central fluid conduit. The outer tubular body assemblage defines a generally annular conduit in surrounding relationship to the central tubular body assemblage. A circulation control valve assembly surrounds an upper portion of the central tubular body assemblage.

During run-in, a radial port in the upper end of the central tubular body assemblage permits circulation of fluid down through the fluid supply conduit and outwardly through a port in the control valve assembly into the well bore. A valve seat is provided in the central conduit above such radial port for reception of a ball which is dropped when the tool has reached the approximate position in the well bore where treatment is desired. The dropping of the ball permits fluid pressure of the supplied fluid to be increased and this affects the axial shifting of an annular piston in the control valve assembly to affect a closure of the aforementioned radial port and the opening of a second radial port in the central tubular body assemblage permitting the bypassing of the ball and the check valve to supply fluid to the central conduit.

Appropriate ports are provided in the medial portion of the central tubular body assemblage which, in the run-in position, provide fluid communication between the central conduit and the outer conduit, and ports in the outer tubular body assemblage provide communication with the interior of the annular elastomeric elements which constitute the inflatable packing elements. A compression spring holds the outer tubular body assemblage in said run-in position relative to the central tubular body assemblage. Thus, when the pressure of the supplied fluid is increased, the inflatable elements are inflated into sealing engagement with the well bore.

In this connection, it should be mentioned that the term well bore is herein applied in a generic sense. It can mean either the bore of casing mounted in a cased well or the drilled bore of an uncased well. Since inflatable packing elements are being employed, a sealing engagement can be achieved with either form of bore wall. Of course, with a casing in stalled, the chemical treatment can be applied to only those portions of the well bore where casing perforations exist to provide communication with a particular formation for which treatment is desired.

During the inflation of the inflatable packing elements, a radial port in the outer tubular body assemblage which is positioned intermediate the two inflatable packing elements is in communication with that portion of the well bore isolated by the inflatable packing elements and any fluid pressure developed in that bore portion by the inflation of the packing elements is diverted by the aforementioned radial port to the well bore portion above the uppermost packing element.

After inflation has been completed, the central tubular body assemblage is moved upwardly through the application of an upward force to the central tubular assemblage by the coiled tubing. Such upward movement compresses the aforementioned spring and is limited by a pin and slot connection between the central tubular body assemblage and the outer tubular body assemblage. The distance of such displacement is such as to bring the inflation ports in the central tubular body assemblage upwardly beyond annular seal elements disposed between the exterior of the central tubular body assemblage and the interior of the outer tubular body assemblage, thus affecting a trapping of the fluid pressure previously supplied to the inflatable packing elements and insuring that such elements will remain in their inflated condition.

Testing of the adequacy of the seals affected by the two inflatable packing elements can then be affected through the supply of a suitable pressured fluid to the aforementioned radial port through the central conduit.

The upward movement of the central tubular body assemblage also causes a radial port in the outer tubular body assemblage to move into communication with an annular valve chamber defined in the upper portions of the outer tubular body assemblage. Such valve chamber has a radial port communicating with the well bore and such port is normally isolated by a sleeve piston mounted in the chamber and shearably secured in a port isolating position. Increasing the pressure of the fluid supplied to the central conduit will produce a pressure force on the piston sufficient to affect the shearing of the shear screws holding the piston in position and causing the piston to move upwardly to provide communication between the central conduit and the well bore above the uppermost inflatable element. When this condition has been achieved, the application of a pressured treatment fluid, such as an acid, to the surface end of the supply conduit will affect the forcing of all pressurizing or testing fluid contained in the supply conduit downwardly to the tool and then outwardly into the well bore above the inflated packing elements so that such pressurizing or testing fluid does not dilute the subsequent treatment procedure by the treatment fluid.

In the normal operation of the apparatus, the central tubular assemblage is then permitted to move downwardly to its run-in position under the bias of the spring which opposed its upward movement. Thus, no set down weight is required to be applied through the coiled tubing. As this downward movement occurs, a plurality of circumferentially disposed, spring pressed locking segments move inwardly into engagement with a groove on the exterior of the central tubular body assemblage and provide an abutment which effectively limits any subsequent upward movements of the central tubular body assemblage to a distance which does not permit communication of the fluid within the tool with the radial port in the valving chamber. Such downward movement would, of course, affect the deflation of the inflatable packing elements, but this can be prevented by maintaining an adequate fluid pressure in the central conduit.

The chemical treatment of the isolated well bore portion can then proceed in conventional fashion. At the completion of the treatment, it is generally desired to move the treatment apparatus to another position in the well bore. This is conveniently accomplished merely by releasing the upward force applied to the central tubular body assemblage and permitting it to move downwardly under the influence of the compressed spring. Such downward movement affects the alignment of ports in the central tubular body assemblage and the outer tubular body assemblage so that pressured fluid within the inflatable elements can drain into the central conduit from which any fluid pressure has been removed.

A rupture disc is provided in the lower portions of the central tubular body assemblage to permit the rupturing thereof under the influence of a fluid pressure which is greater than any of the fluid pressures employed for inflation or treatment. Such rupturing provides a passage for fluid to drain out of the deflated packing elements to facilitate their passage upwardly through any previously installed tubing string.

Lastly, a ball is dropped to engage a valve seat provided on a sleeve shearably secured in the extreme upper portion of the central conduit above the previously mentioned central valve. This permits a fluid pressure to be developed which operates on the sleeve to release it and move to uncover a radial port communicating with the well bore, thus permitting circulation to be accomplished during the retrieval of the testing apparatus from the well bore.

Further objects and advantages of the method and apparatus of this invention will be readily apparent to those skilled in the art from the following detailed description, taken in conjunction with the annexed sheets of drawings, on h is shown a preferred embodiment of the invention.

DESCRIPTION OF THE PREFERRED EMBODIMENT

Figure 1A:
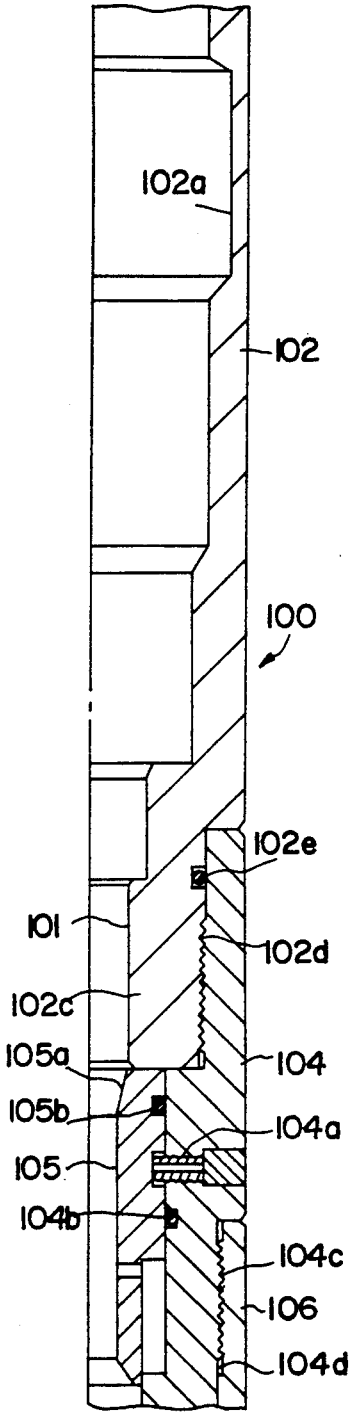
FIGS. 1*a*, 1B, . . . 1L collectively constitute a vertical quarter sectional view of a well treatment apparatus embodying this invention.
Figure 1B:
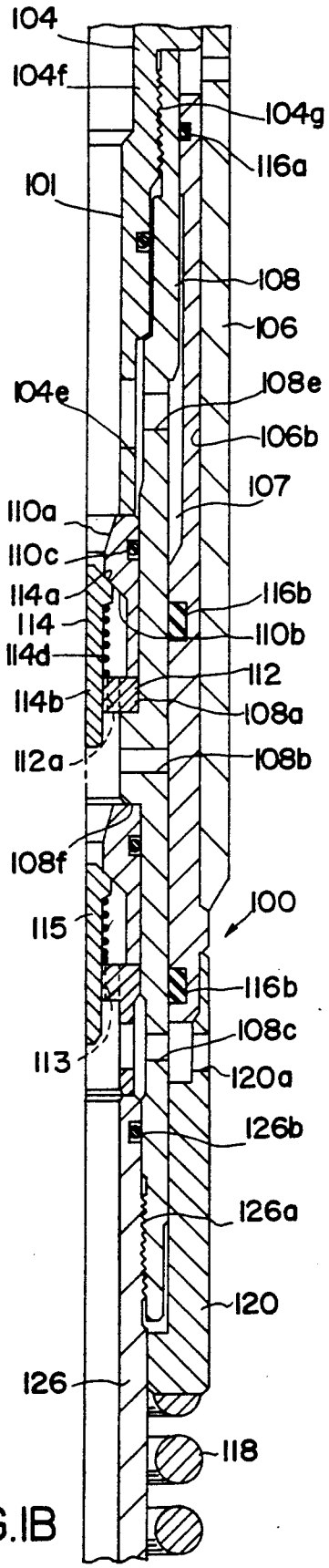

Referring to Figs. 1A, 1B, . . . 1L of the drawings, a formation testing apparatus embodying this invention comprises a central tubular assemblage 100 which has its lower portions surrounded by an outer tubular assemblage 200. Thus, the central tubular assemblage 100 projects beyond the outer tubular assemblage 200 at its upper end. The uppermost part of the central tubular assemblage 100 comprises a connection sub 102 which defines on its inner surface a recess or profile 102*a* for engagement by a running tool, carried coiled or threaded tubing (not shown). The lower end of the connecting sub 102 has a reduced diameter portion 102*c* which is provided with external threads 102*d* and mounts an O-ring 102*e*. These elements affect a threaded sealed connection with an inner valve housing 104. Inner valve housing 104 is connected by one or more shear screws 104*a* to a ball valve seating member 105 having an upwardly facing ball valve seat 105*a*. O-rings 105*b* and 104*b* straddle the shear screw 104*a* and thus effectively seal off any fluid flow through the shear screw 104*a*. Additionally, inner valve housing 104 is provided with external threads 104*c* for securement to the upper end of an outer valve housing 106. This connection is sealed by an O-ring 104*d*.

The lower end of the inner valve housing 104 is provided with a reduced diameter portion 104*f* which has external threads 104*g* engaging internal threads provided in a coupling sleeve 108. Sleeve 108 cooperates with the internal surface 106*b* of the outer valve housing 106 to define an annular fluid pressure chamber 107. Aligned radial ports 104*e* and 108*e* communicate fluid pressure chamber 107 with the bore 101 of the central tubular assemblage 100.

An upper valve seating sleeve 110 is sealably mounted within the interior of the coupling sleeve 108 by being clamped between the lower end of the valve housing sub 104 and a guide ring 112 which abuts an upwardly facing shoulder 108*a* formed on the interior of the coupling sleeve 108. Guide ring 112 has axial passages 112*a* formed therein. Valve seating sleeve 110 defines an upwardly facing ball valve seating surface 110*a* upon which a ball is gravitated or pumped after run-in. Additionally, valve seating sleeve 110 further defines a downwardly facing seating surface 110*b* with which a similarly shaped head portion 114*a* of a check valve 114 sealably cooperates. The stem portion 114*b* of check valve 114 is supported by guide ring 112. A spring 114*d* urges the check valve 114 into sealing engagement with the downwardly facing surface 110*b*. An O-ring 110*c* prevents fluid passage around the exterior of the valve seat element 110.

Thus, prior to the dropping of a ball onto the upwardly facing seating surface 110*a*, fluid flow downwardly through the central tubular body assemblage is prevented until the fluid pressure exceeds that level required to move the check valve 114 downwardly out of engagement with seating surface 110*b*.

Below the guide ring 112, the coupling sleeve 108 is provided with two vertically spaced sets of radial ports 108*b* and 108*c*. An annular piston 116 is mounted in the annular fluid pressure chamber 107 and is sealably engaged with the inner wall thereof by O-ring 116*a* and seal 116*b*. The lower end of piston 116 is radially enlarged and provides a mounting for seal 116*b* which, in the run-in position of the apparatus, are disposed in the position illustrated in FIG. 1B straddling the radial ports 108*b*. Thus, in the run-in position of the apparatus, fluid circulation may be maintained by pumping fluid downwardly through the bore 101 of the central tubular assemblage 100 to exit to the well annulus through radial port 108*c* and then through port 120*a* in a spring seat 120. Since the circulation fluid is pressurized, the check valve 114 will be shifted downwardly to permit the fluid flow down the central bore 101 to the radial ports 108*c*.

Figure 2A:
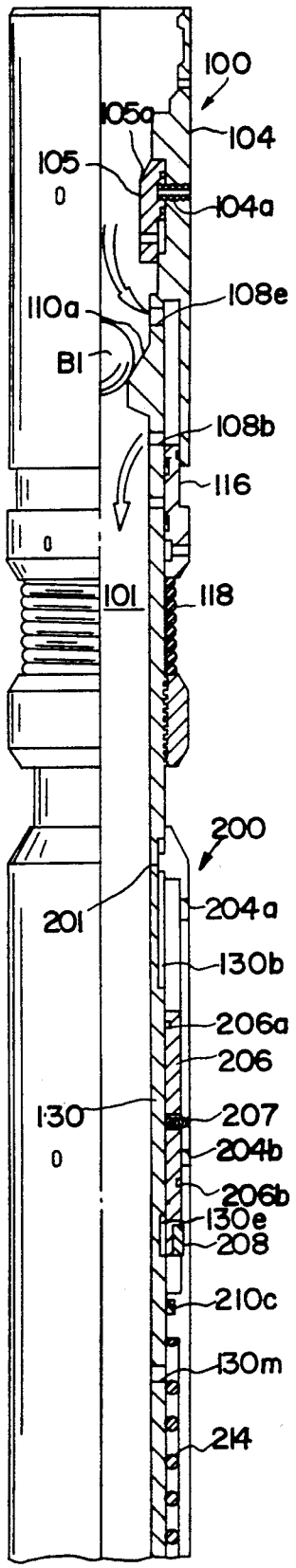
FIGS. 2A, 2B, and 2C collectively constitute a schematic quarter sectional view of the well treatment apparatus illustrating the position of the components in the inflation step of the process.

When a ball B1 is dropped on the upwardly facing seating surface 110*a*, as illustrated in FIG. 2A, fluid pressure may be applied at a higher level to the fluid pressure chamber 107 by passage through radial ports 104*e* in the inner valve housing 104. Such fluid pressure is increased to a level sufficient to move the piston 116 downwardly to a position, illustrated in FIG. 2B where the re-circulation ports 108*c* are sealed off by the piston seals 116*b* and 116*c* straddling such ports. In this position of the piston, the ball valve B1 is effectively bypassed with the fluid flowing out through ports 104*e* and then back into the bore 101 of the central tubular assemblage 100 through radial ports 108*b*.

To prevent any backflow through the ports 108*b*, a lower check valve 115, substantially identical to check valve 114, is mounted in bore 101 immediately below radial ports 108*b*. Check valve 115 is held in position between a guide ring 113 and a downwardly facing shoulder 108*f* on inner valve housing 108. Guide ring 113 abuts the top end of an extension sleeve 126. Check valve 115 performs another function during deflation that will be decided later.

The downward movement of the piston 116 is opposed by a spring 118 which acts on the bottom end of the piston 116 through a spring seat 120. Spring 118 surrounds extension sleeve 126 which is secured by external threads 126*a* to the bottom of connecting sleeve 108. O-ring 126*b* seals this connection. The lower end of spring 118 is abutted by spacer rings 118*a* and an internally threaded abutment sleeve 122 which has relatively coarse internal threads 122*a* which cooperate with similarly shaped threads provided on the exterior of a coupling sub 124. The extent of threaded engagement of the abutment sleeve 122 thus determines the amount of compression applied to compression spring 118. The abutment sleeve 122 is anchored to the bottom of extension sleeve 126 forming a continuation of the central tubular body assemblage 100. The bottom end of extension sleeve 126 is threadably engaged with internal threads 124*a* on coupling 124 and such threads are sealed by an O-ring 124*b*.

The lower end of coupling 124 is provided with internal threads 124*c* which engage the threaded upper end of an elongated body sleeve 130 and are sealed by O-ring 124*d*. Body sleeve 130 extends into the top end of the outer tubular assemblage 200 and, at its lower end (FIG. 1E), is provided with internal threads 130*a* for engagement with external threads provided on the top end of a ball seating sleeve 132. Ball seating sleeve 132 defines at its upper end an upwardly facing ball seating surface 132*a* upon which a ball B2 is carried during run-in. Above the position of ball B2, a ball stop 134 is positioned in a recess 130*b* formed in the body sleeve 130. Ball stop provided with axial passages so as to permit upward fluid flow therethrough when the ball B2 is lifted off its seat 132*a*. Radial ports 132*c* and 130*d* are provided in the ball seat sleeve 132 and body sleeve 130 below and above ball valve B2 for a purpose to be hereinafter described.

Figure 1C:
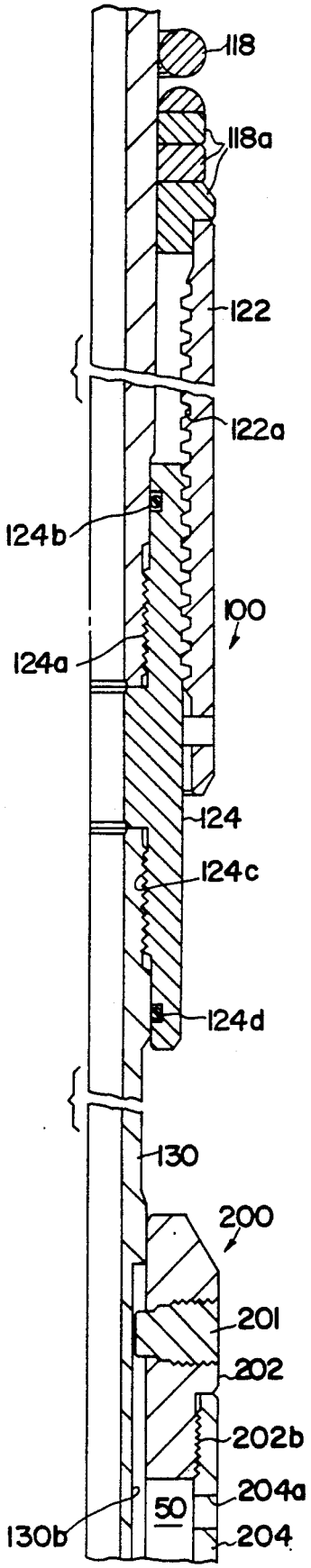
Figure 1D:
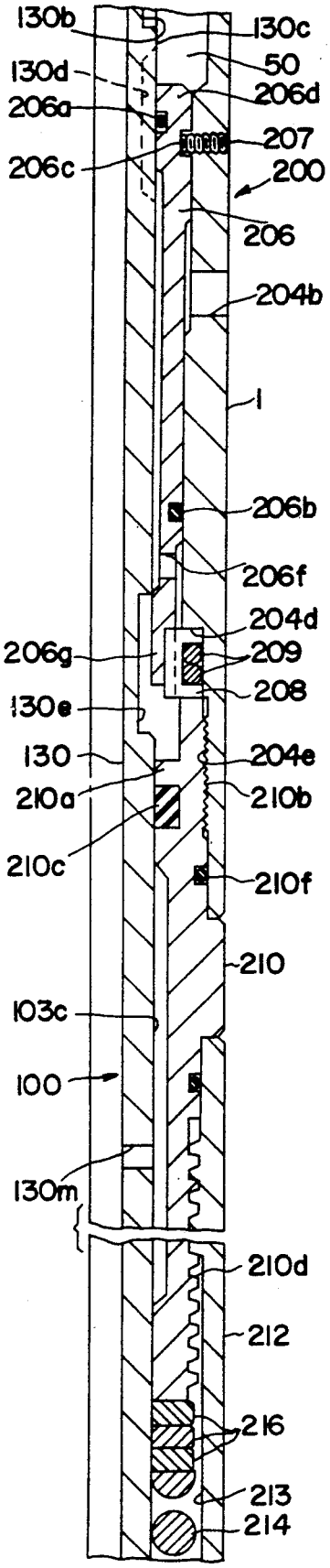
Figure 1E:
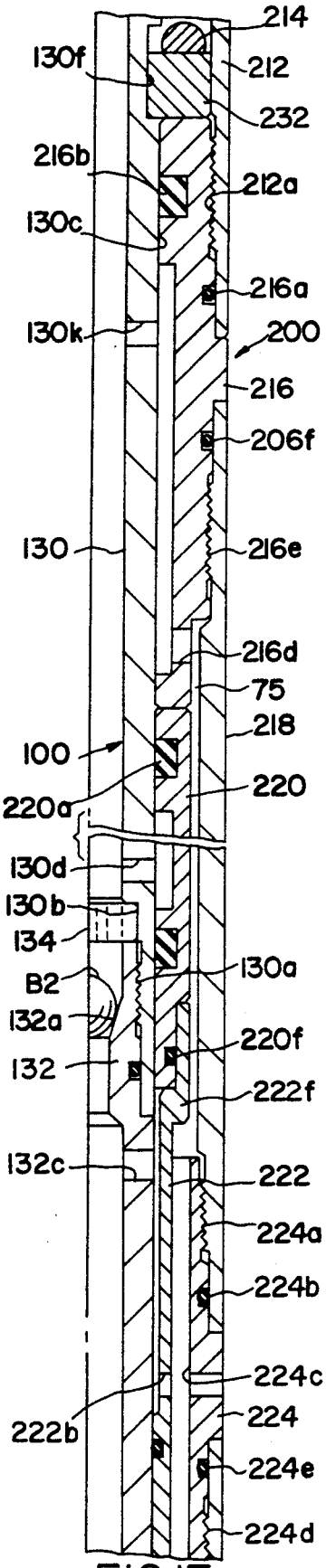
Figure 1F:
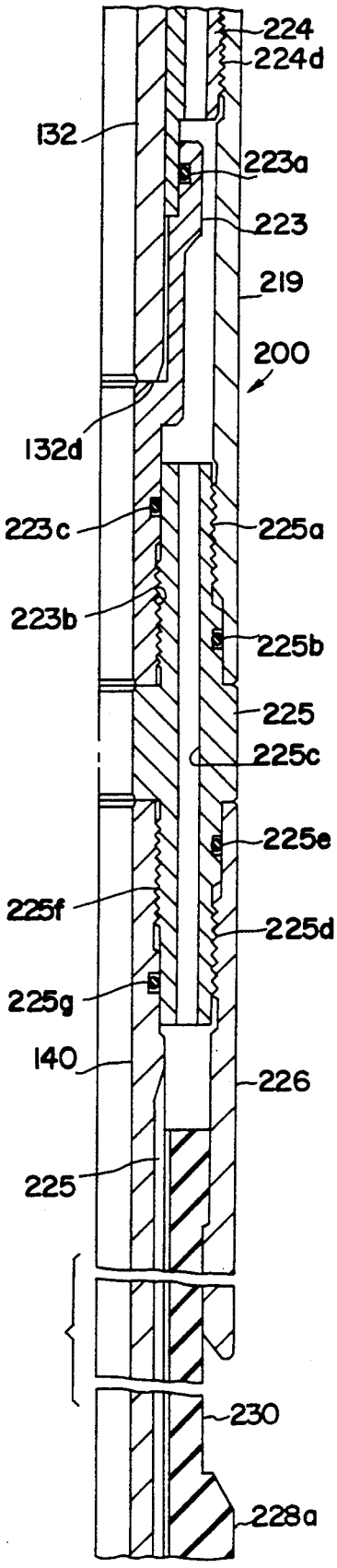
Figure 1G:
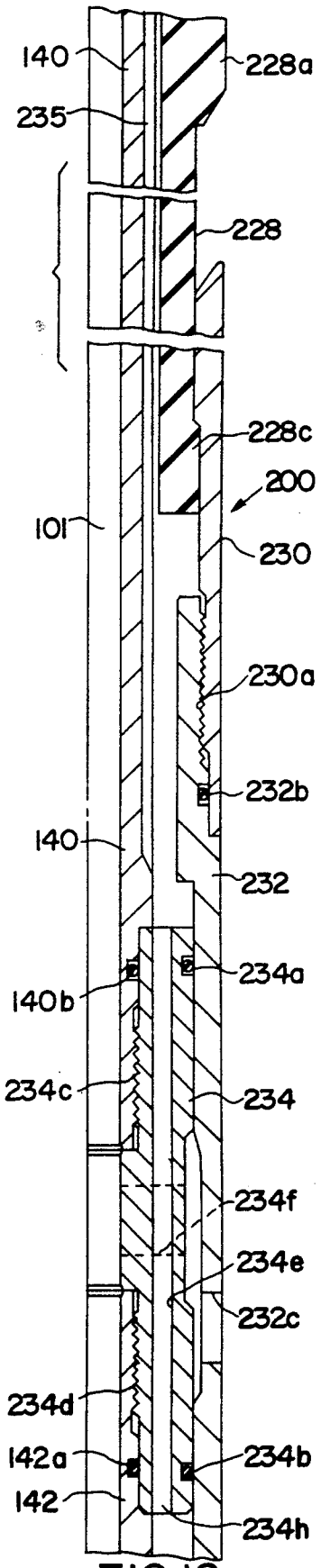
Figure 1H:
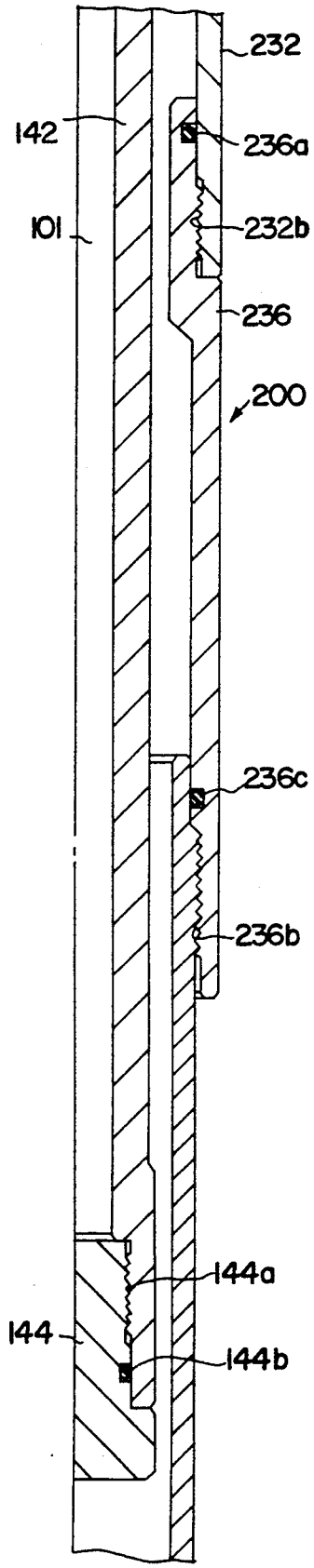
Figure 1I:
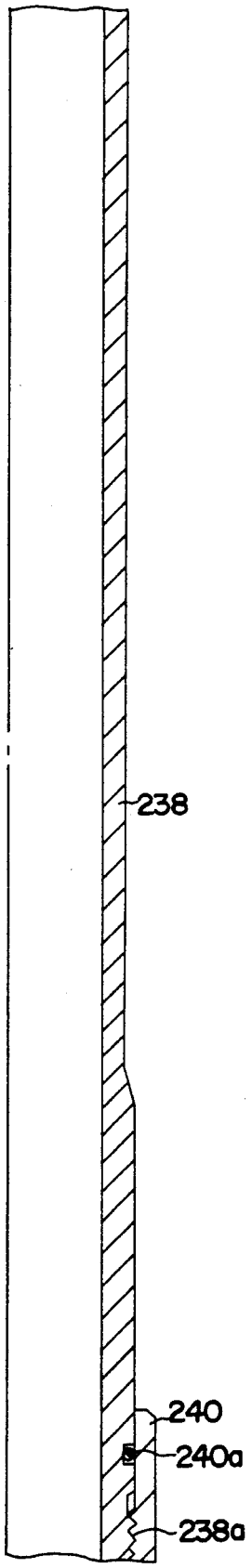

The central body sleeve 130 is further provided near its upper end with an elongated, axially extending slot 130*b* (FIG. 1C). This slot cooperates with an inwardly projecting pin 201 which is mounted in the top sub 202 of the outer tubular housing 200 and thus limits the extent of upward movement of the central tubular assemblage 100 relative to the outer tubular assemblage 200 when such movement is required in the operation of the tool, as will be hereinafter described. Because of the many interactions between elements of the central tubular assemblage 100 and the outer tubular assemblage 200, the description of cooperating portions of these two assemblages will be made concurrently, in the interest of clarity.

Figure 6A:
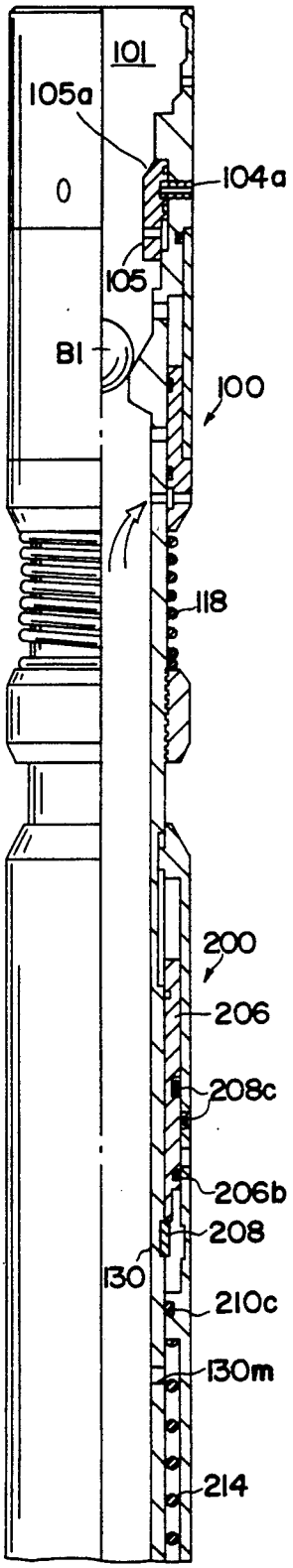
FIGS. 6A, 6B and 6C collectively constitute a schematic vertical quarter sectional view of the well treatment apparatus illustrating the position of the components after deflation of the packing elements to permit movement to another position in the well bore.

As described in the operation of the apparatus, when the body sleeve 130 is manipulated to retain the inflation pressure in the inflatable means, the injection ports 132*c* and 130*d* are placed in communication. Additionally, as shown in FIG. 6A, the valving including body sleeve 130 provides means for escape of inflation fluid into the annulus exterior of the tool during deflation.

As stated, the outer tubular assemblage 200 has its upper end defined by a top sub 202. The lower end of top sub 202 is externally threaded at 202b and engages internal threads in an elongated lock housing sleeve 204. Lock housing sleeve 204 is provided with axially spaced vertical ports 204a and 204b and, in cooperation with the external surface 130c of the body sleeve 130, defines an annular fluid pressure chamber 50. An annular piston 206 is sealably mounted within the annular fluid pressure chamber 50 by O-rings 206a and 206b. Piston 206 is secured in its run-in position by one or more shear pins 207 which pass radially through the lock housing sleeve 204 and engage a recess 206c in an enlarged diameter portion 206d of the piston. This enlarged diameter portion is positioned intermediate the previously mentioned radial ports 204a and 204b in the run-in position of the apparatus. The piston seal 206a is bypassed in the run-in position of the apparatus by a plurality of relatively short, axially extending grooves 130d provided in the exterior of the body sleeve 130.

The lower end of piston 206 is provided with one or more radial ports 206f and immediately below such radial ports has a reduced diameter section 206g which functions as a retainer for lock segments 208 which are biased radially inwardly by garter springs 209. The lock segments 208 are retained by a downwardly facing shoulder 204d on lock housing sleeve 204 and the top end 210a of the next element 210 of the outer tubular assemblage 200 which is threadably secured by threads 210b to the bottom end of the lock housing sleeve 204.

An annular groove 130e is formed in the body sleeve 130 of the central tubular assemblage 100 and it is readily apparent that when the lower end 206g of the piston 206 is moved upwardly out of engagement with the locking segments 208, such segments will contract and latch into the annular groove 130e, for a purpose to be hereinafter described.

Proceeding downwardly on the tool, the next element of the outer tubular assemblage 200 is a spring seat sleeve 210. Spring seat sleeve 210 has a radially inwardly thickened top portion 210a secured by internal threads 204e to the bottom end of lock housing sleeve 204 and sealed by O-ring 210f. Top portion 210a mounts a seal ring 210c for sealing engagement with the external surface 130c of the body sleeve 130. The lower end of the spring seat sleeve 210 is provided with relatively coarse external threads 210d with which the top end of a spring housing sleeve 212 is threadably engaged. Obviously, the coarse threads 210d permit a substantial range of adjustment of the position of the spring housing sleeve 212 relative to the spring seat sleeve 210. A compression spring 214 is mounted in the annulus 213 defined between the spring housing sleeve 212 and the body sleeve 130 of the central tubular body assemblage 100. The top end of compression spring 214 abuts the bottom end of the threaded portion 210d of spring seat sleeve 210 through a selected number of washers 216. The lower end of spring 214 is abutted by a segmented ring 232 which is engaged in an annular groove 130f in the body sleeve 130. Thus, upward movement of the central tubular body assemblage 100 relative to the outer tubular body assemblage 200 is opposed by the spring 214. The segmented ring 232 abuts the top end of a coupling 216 which is secured to the bottom end of the spring housing 212 by internal threads 212a and these threads are sealed by an O-ring 216a. The upper end of coupling 216 mounts an annular seal element 216b which is in engagement with the external surface of the inner body sleeve 130. An inflation port 130k is provided in body sleeve 130 slightly below seal 216b. The lower end of coupling 216 is provided with a port 216d, the purpose of which will be hereinafter defined. Additionally, the lower end of coupling 216 is provided with external threads 216e which mount the top end of an external body sleeve 218. These threads are sealed by an O-ring 206f.

In the annulus 75 between the outer body sleeve 218 and the inner body sleeve 130, a valving sleeve 220 is mounted by being trapped in position between the lower end of the coupling 216 and a counterbored upper end 220f of an upper trapping sleeve 222. An O-ring 220f seals this abutting connection. Upper trapping sleeve 222 is provided with one or more radial ports 222f are disposed adjacent radial ports 224c in an upper coupling 224 which is secured to the bottom of upper external body sleeve 218 by threads 224a and O-ring 224b. A lower body sleeve 219 connects to upper coupling threads 224d which are sealed by O-ring 224e. A lower coupling 225 is secured to lower body sleeve 219 by threads 225a and O-ring 225b.

The bottom end of upper trapping sleeve 222 abuts the top end of a lower trapping sleeve 223 and this connection is sealed by O-ring 223a. The bottom end of trapping sleeve 223 is secured by external threads 223b to lower coupling 225. These threads are sealed by an O-ring 223c.

Internal seals 220a and 220b are provided in the opposite ends of valving sleeve 220 and are in sealing engagement with the exterior of the inner body sleeve 130; straddling a port 130d in inner body sleeve 130.

There is thus defined around the exteriors of the valving sleeve 220 and the trapping sleeve 222 an annular fluid passage 75. This passage is continued through the couplings 224 and 225 by a plurality of peripherally spaced, axially extending flow passages 224k and 225c so that the entire flow passage 75 can be defined as being generally annular and in surrounding relationship to the inner tubular body assemblage 100.

It should be noted that the central tubular body assemblage 100 terminates at the bottom 132d of valve seating sleeve 132, hence is vertically movable relative to the outer tubular body assemblage 200 to the extent permitted by pin 201 and slot 130b.

Proceeding downwardly from the lower coupling 225, external threads 225d mount an anchor sleeve 226 for securing the upper end of an inflatable elastomeric packing element 228. Threads 225d are sealed by an O-ring 225e.

Internal threads 225f are provided on the lower end of coupling 225 for securement to the top end of a lower inner body sleeve 140 and are sealed by O-ring 225g. An annular fluid passage 235 is maintained between the exterior of the lower inner body sleeve 140 and the internal surface of the elastomeric sleeve 228 for the passage of fluid thereunder. At a midpoint on the elastomeric sleeve 228, a reinforcing layer 228a of elastomeric material is provided with which the well bore is primarily engaged when the elastomeric sleeve 228 is inflated by pressured fluid applied through the annular passage 235.

The lower end 228c of the annular elastomeric element 228 is conventionally secured in position by a lower anchor sleeve 230. The lower end of anchor sleeve 230 is provided with internal threads 230a for securement to the top end of an injection port sleeve 232. O-ring 232*b* seals these threads. Injection port sleeve 232 is provided with one or more enlarged radial ports 232*c* and such sleeve snugly surrounds a coupling 234. Coupling 234 is provided with O-ring seals 234*a* and 234*b* which straddle the injection port 232*c*. Additionally, a radial port 234*f* communicates between central fluid passage 101 and ports 232*c*.

The coupling 234 is further provided at its upper end with internal threads 234*c* for engaging the bottom end of the lower bottom inner sleeve 140 of the outer tubular body assemblage. An O-ring 140*b* seals this threaded connection. Internal threads 234*d* on coupling 234 provide securement to the top end of a bottom inner sleeve element 142 of the outer tubular assemblage 200. These threads are sealed by an O-ring 142*a*.

A plug 144 is threadably secured by external threads 144*a* to the bottom end of the sleeve 142. This threaded connection is sealed by an O-ring 144*b* and terminates the central fluid passageway 101 which extends upwardly through the entire central tubular assemblage 100.

The outer tubular assemblage 200 extends downwardly from the coupling 234 to provide for the connection of a second elastomeric packing element inflatable by fluid pressure supplied through the generally annular conduit which extends through the entire outer tubular body assemblage 200. It should be mentioned that the coupling 234 is provided with a plurality of peripherally spaced, longitudinally extending fluid passages 234*e* which affect a continuation of the generally annular fluid passageway 75 of the outer tubular body assemblage 200.

The lower end of the injection sleeve 232 is provided with internal threads 232*b* which are secured to a space-out sleeve 236. These threads are sealed by an O-ring 236*a*. Spaceout sleeve 236 is provided with threads 236*b* and a seal element 236*c* which engage corresponding threads provided on the top end of a second space-out sleeve 238. The bottom end of second space-out sleeve 238 is provided with threads 238*a* which are engagable with internal threads provided on a cross-over collar 240. A seal 240*a* seals the threads 238*a*. Cross over sub 240 has a lower portion 240*b* provided with external threads 240*c* and internal threads 204*d*. The external threads 240*c* are engaged with an upper elastomeric retainer sleeve 242 and the threads are sealed by O-ring 240*e*. The internal threads 240*d* are engaged with the upper end of a lowermost body sleeve 244 which extends to the bottom of the outer tubular body assemblage 200.

An annular elastomeric packing element 246 identical to the upper packing element 228 previously described has its top end secured by the upper retainer sleeve 242 and its lower end secured by a lower elastomeric retainer sleeve 248. The central portions of the annular elastomeric packing element 246 have an enlarged elastomeric well bore contact portion 246*a* integrally bonded thereto.

An annular fluid passage 247 is defined between the inner surface of the annular elastomeric packing element 246 and the external surface of the lowermost body sleeve 244, thus providing a continuation of the generally annular fluid passage 75 extending through the outer tubular body assemblage 200.

The lower end of the lower elastomeric anchor sleeve 248 is provided with internal threads 248*a* which are engaged with the upper end of a fill port sub 250. O-ring 250*a* seals the threads 248*a*.

The fill port sub 250 is provided with a radial fill port 250*b* by which the internal cavities of the outer tubular assemblage 200 may be filled with clean fluid at the well surface to eliminate air pockets. A plug 252 is then inserted in the fill port 250*b* to seal this opening.

The lower end of fill port sub 250 is provided with external threads 250*c* which are secured to a hold down sub 254. Hold down sub 254 is provided at its lower end with an inwardly projecting ridge 254*a* and such ridge is rigidly secured to a ring stop 255 by a plurality of screws 254*b*. Ring stop 255 is provided with a counterbore 255*a* in its upper end and this counterbore engages a downwardly facing shoulder 244*c* on lowermost body sleeve 244 to secure the lower end of the lower elastomeric retainer sleeve 248 to the lowermost body sleeve 244.

The lowermost body sleeve 244 is additionally provided with vertically spaced ports 244*a* and 244*b* respectively underlying the top and bottom ends of the upper elastomeric anchor sleeve 242 and the lower elastomeric sleeve 248. These ports function as inflation ports, in a manner that will be subsequently described.

The bottom end of the lowermost body sleeve 244 is provided with external threads 244*d* to which is secured a rupture cap 256. Threads 244*d* are sealed by an O-ring 256*a*. The medial portion of rupture cap 256 is provided with a radial port 256*b* within which is mounted a conventional rupture disc 258 which has the characteristic of being rupturable at a predetermined fluid pressure, higher than any of the fluid pressures utilized in the normal operation of the tool so that the port 256*b* may be opened to drain any residual fluid contained within the deflated elastomeric packing elements 230 and 246 only prior to removal of the entire tool from the well.

The operation of the aforedescribed tool will now be described by the remaining figures of the drawings which constitute schematic quarter sectional views of the apparatus shown in detail in FIGS. 1A–1L which has been heretofore described. Many details appearing in FIGS. 1A through 1L are omitted in the schematic views and the entire apparatus has been substantially shortened in length in order to reduce the number of sheets of drawings required.

As previously mentioned, FIGS. 1A, 1B . . . 1L show the components of the tool in their run-in position. It will be noted that circulation may be affected by passing pressurized fluid downwardly through the central bore 101 of the central tubular assemblage 100 which then passes outwardly through port 108*c* in the central tubular assemblage 100 and port 120*a* provided in the spring seat 120 surrounding the port 120*a*.

Figure 2B:
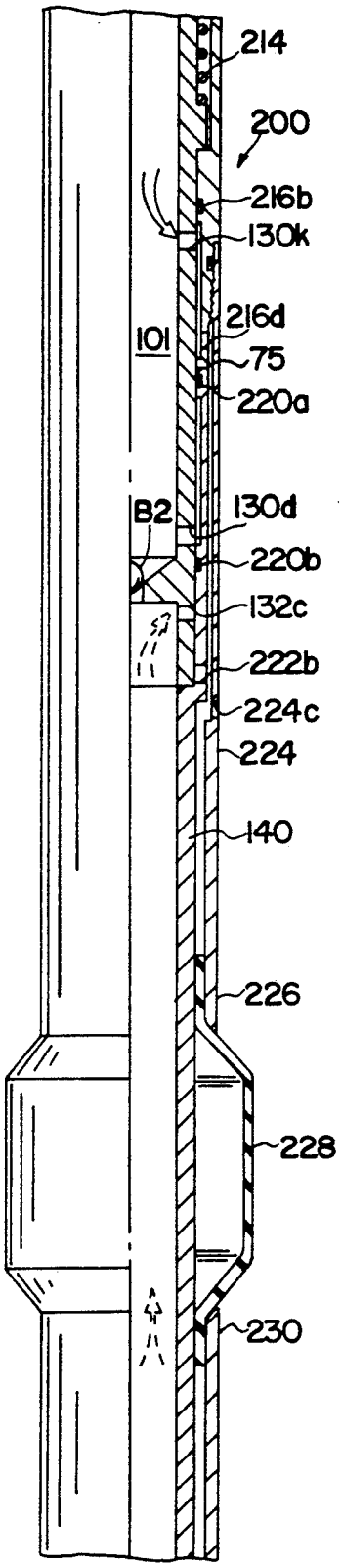
Figure 2C:
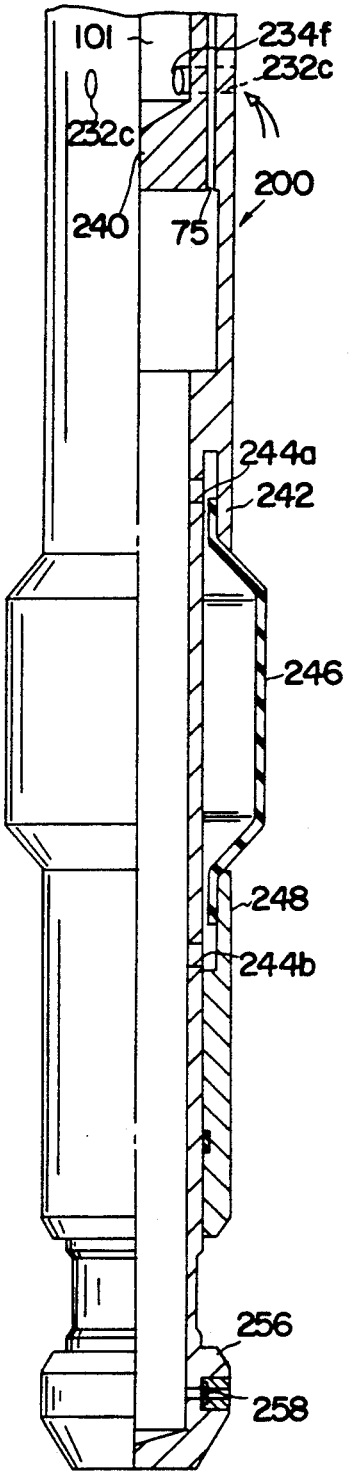

When the tool is positioned in the selected portion of the well bore to be chemically treated, a ball B1 is dropped to seat on the upwardly facing surface 110*a* of the central tubular assemblage 100 as shown in FIG. 2A, permitting a build up of fluid pressure in central bore 101 above ball B1. This produces a downward shifting of the piston 116, against the bias of the spring 118, and closes the port 108*c* in the central tubular assemblage 100 to prevent fluid flow outwardly into the well bore, while at the same time opening the port 108*b* to permit fluid flow bypassing the ball B1. Thus, pressured fluid may flow down the central passage 101 in the central tubular assemblage and, since passage 101 is blocked by ball B2, thence pass outwardly through ports 130*k* and 216*d* into the generally annular passageway 75 provided in the outer tubular body assemblage 200. Pressured fluid in this passageway affects the inflation of the upper and lower elastomeric packing elements 228 and 246 into sealing engagement with the well bore as shown in FIGS. 2B and 2C.

During inflation of the packing elements, well fluids may be trapped therebetween and pressurized by the expanding packing elements. This is undesirable, so a flow path is provided through testing and treatment ports 232*c* and 234*f* to the lower end of central passage 101, then outwardly through ports 132*c*, 222*b* and 224*c* into the well bore above the upper packing element 228, as shown by the dotted arrows in FIGS. 2A and 2B.

Figure 3A:
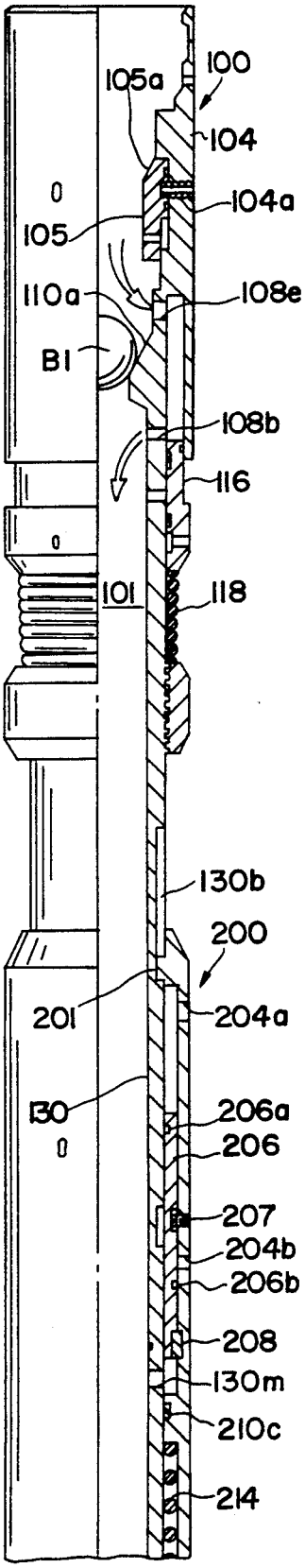
FIGS. 3A, 3B, and 3C collectively constitute a vertical quarter sectional view of the well treatment apparatus showing the components in their positions required for the pressure testing step.
Figure 3B:
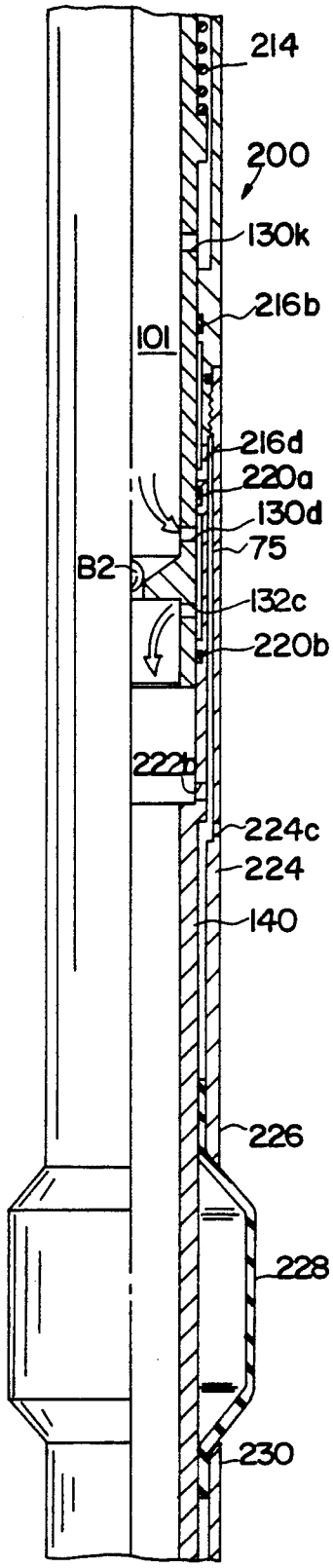
Figure 3C:
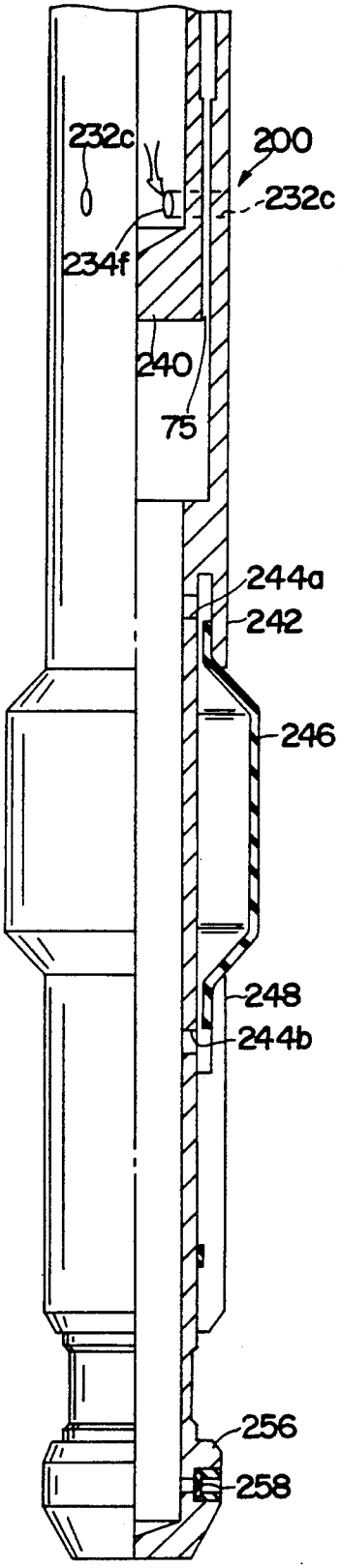

Referring now to FIGS. 3A, 3B and 3C the pressured fluid expanding the elastomeric packing elements is trapped therein by an upward movement of the inner tubular body assemblage 100 relative to the outer tubular body assemblage 200 which is now anchored to the well bore. This upward movement is limited by pin 201 and slot 130*b* and seals off the inflation ports 130*k* by the seal 216*b* and hence traps the fluid pressure within the expanded elastomeric packing elements 228 and 246. Spring 214 is compressed.

At the same time, a fluid passage is opened through the ports 130*d* and 132*c* bypassing the ball B2 which has been in position during all of the previous operations blocking downward flow in central conduit at that point. This permits pressured fluid of a level sufficient to test the integrity of the seals affected by the expanded elastomeric packing elements to be applied to the well bore portion intermediate the upper and lower elastomeric packing element through the testing and treatment ports 234*f* and 232*c* (FIG. 3C).

Figure 4A:
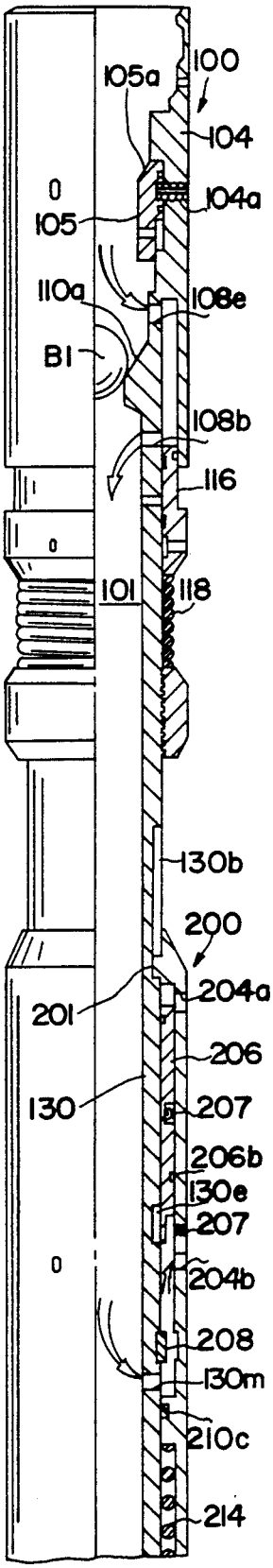
FIGS. 4A, 4B, and 4C collectively constitute a schematic vertical quarter sectional view of the well treatment apparatus with the components shown in their positions for affecting spotting of the well treatment fluid.
Figure 4B:
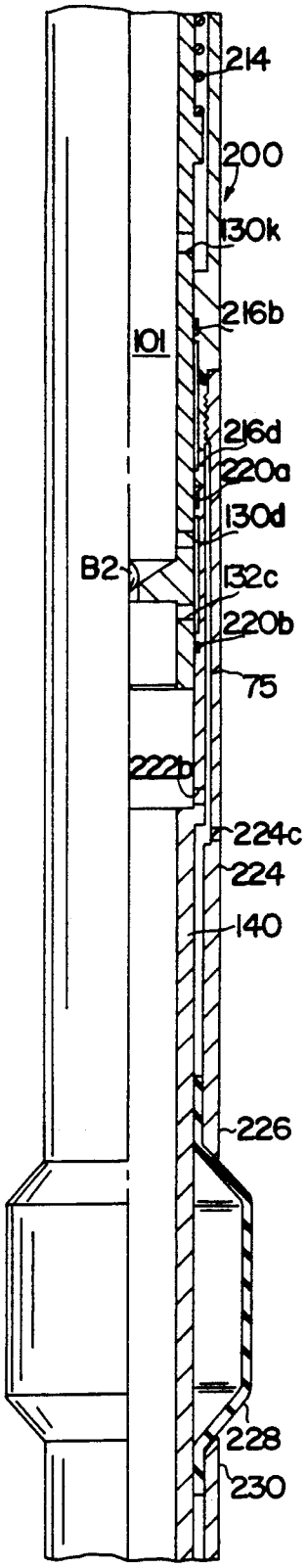
Figure 4C:
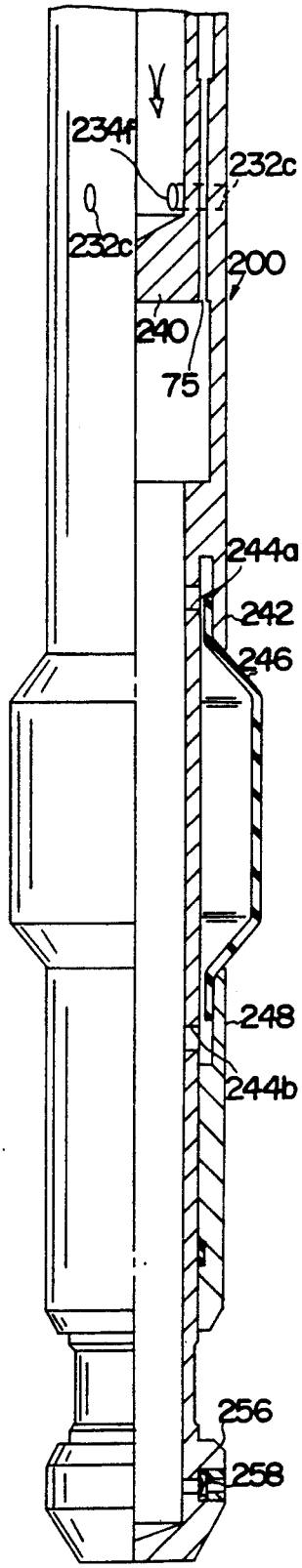

The next step in the operation, illustrated in FIGS. 4A, 4B and 4C, is to increase the fluid pressure supplied to the tool through the central conduit 101 in the central tubular body assemblage 100 to a level sufficient to shear the shear pins 207 securing the locking piston 206 in position and causing such locking piston to move upwardly. In its upward position, the seal 206*b* carried by the piston 206 is disposed above the radial spotting port 204*b* provided in the outer tubular assemblage 200, hence permitting fluid existing in the supply conduit, which is preferably coiled tubing, to drain down through the central passage 101 in the central tubular body assemblage 100 and outwardly through port 130*m* in the inner body sleeve 130 and the radial spotting port 204*b* in the outer tubular body assemblage 200. Such drainage is preferably accomplished by applying pressured treatment fluid at the surface to the upper end of the fluid supply conduit. Thus, the pressurizing fluid theretofore supplied to the tool that remains in the fluid supply conduit will be forced out of the tool into the well bore, hence eliminating the necessity of diluting the treatment fluid by pumping such excess fluid into the well bore area to be treated. Such operation is referred to as spotting of the treatment fluid.

The next operation of the tool is to relax the upward tension on the inner tubular body assemblage 100 and permit it to be returned by spring 214 to its deflate position, which is the same position employed for inflation. Deflation of the expanded elastomeric packing elements is, however, prevented at this stage by maintaining a suitable fluid pressure on the treatment fluid being applied to the tool.

Figure 5A:
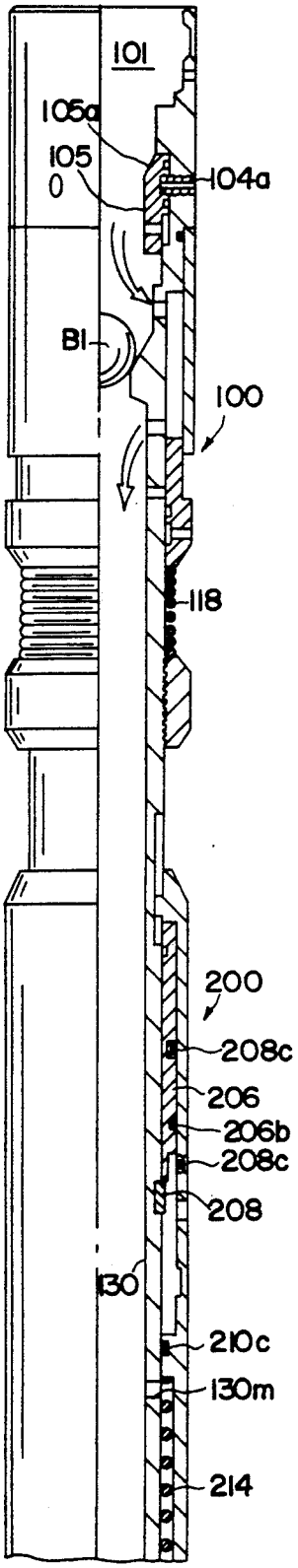
FIGS. 5A, 5B, and 5C collectively constitute a schematic vertical quarter sectional view of the apparatus with the components thereof shown in their positions for affecting treatment of the well bore portion between the inflated packing elements.

The previously described upward movement of the piston 206 permits the spring biased locking segments 208 to be urged inwardly into engagement with the external surface of the body sleeve 130 of the central tubular body assemblage 100. Thus, when the downward movement of the central tubular body assemblage 100 occurs under the bias of the compressed spring 214, the annular recess 130*e* moves into axial alignment with the spring biased locking segments 208 and they snap into the annular recess 130*e*, as shown in FIG. 5A. This engagement has no effect on the downward movement of the central tubular body assemblage 100, but any subsequent upward movement of the central tubular body assemblage 100 is limited by the presence of the locking segments 208 to a distance which does not bring the port 130*m* on the central body sleeve 130 past seal 210*c* in the outer tubular body assemblage. Thus, there is no need for the operator to be concerned about subsequent elevations of the central tubular body assemblage affecting a drainage connection for the treatment fluid contained in the tool.

Figure 5B:
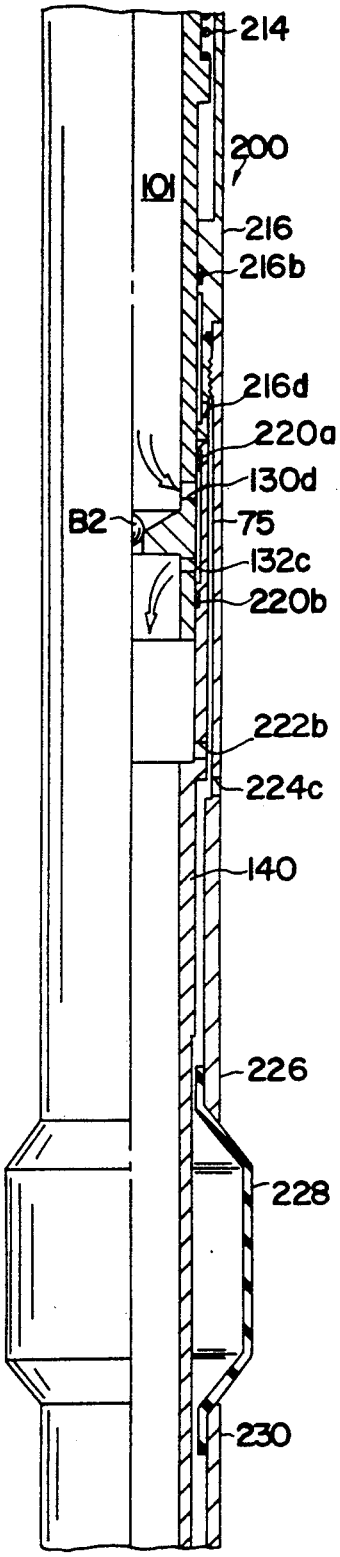
Figure 5C:
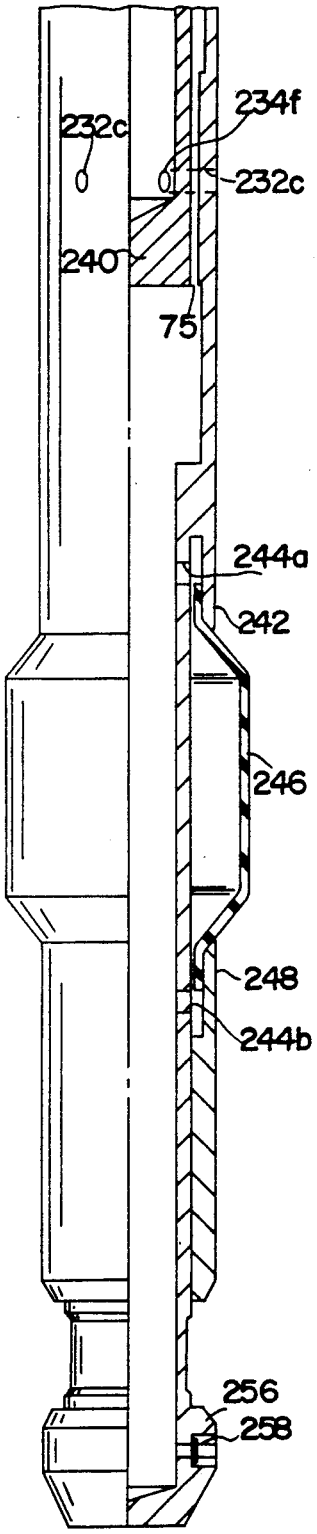

As shown in FIGS. 5A, 5B and 5C, the central tubular body assemblage 100 is then again moved upwardly to a lesser extent than before by virtue of the action of the locking segments 208 and this creates a fluid supply passage from the central passage 101 in the central tubular body assemblage through radial port 234*f* and thence through a radial port 232*c* in the outer tubular body assemblage in the same manner as previously described for the testing operation, and permits pressurized treatment fluid to be supplied to the well bore portion between the expanded elastomeric packing elements.

It is customary to mount a back pressure actuated flapper valve in line with the coiled or remedial tubing and above the aforedescribed formation testing apparatus. Such conventional valve (not shown) is spring biased to a closed position and is opened by fluid pressure supplied to the remedial tubing string. The function of such valve is to protect against blow outs. However, when the surface supplied fluid pressure is released preliminary for deflation, such flapper valve will close, but the fluid displacement produced by such closing may not be sufficient to permit the piston 116 to return to its run-in position under the bias of spring 118. In such situation, the check valve 115 will remain closed, allowing the pressure in the chamber 107 to be reduced when surface pressure is reduced.

Figure 6B:
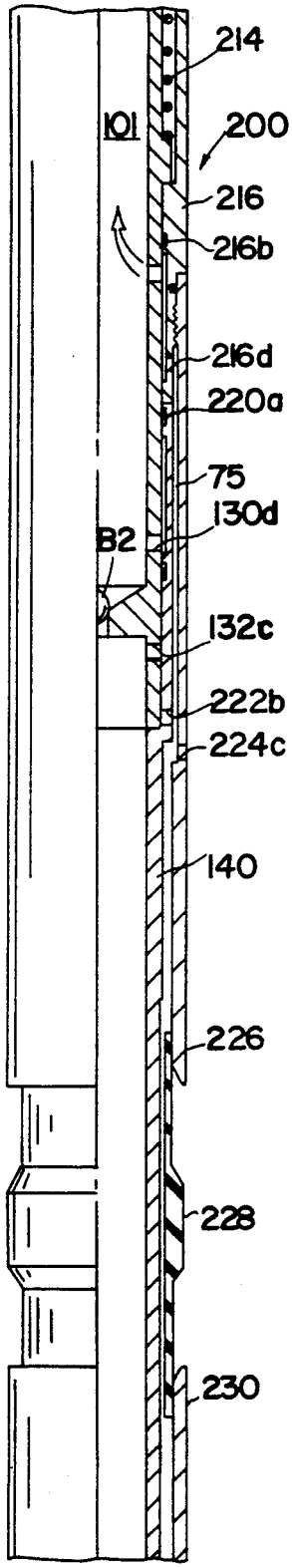
Figure 6C:
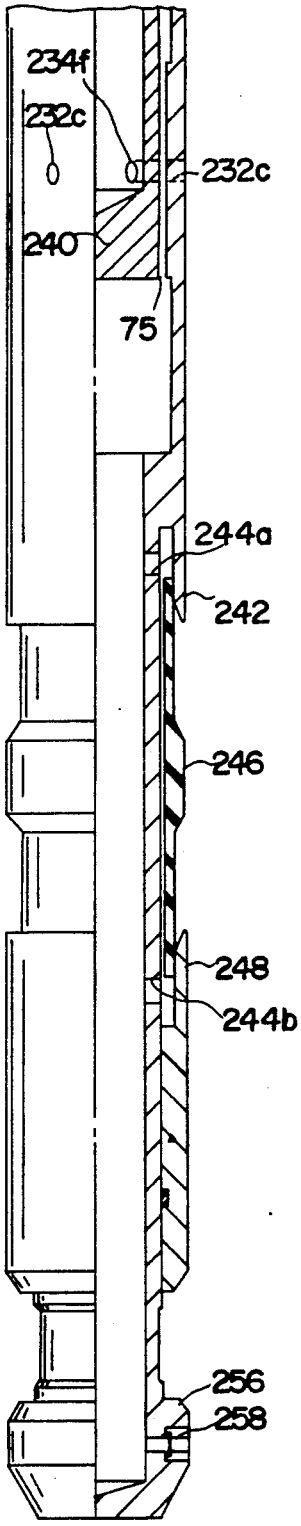

When the treatment of the originally selected well bore portion has been completed, the tension on the central tubular body assemblage is released and it is returned to its deflate position by the compressed spring 214 (FIGS. 6A–6C). This permits the inflated elastomeric packing elements to deflate and the tool can be readily moved in the well bore to another position for treatment of the well bore at the new position.

Figure 7A:
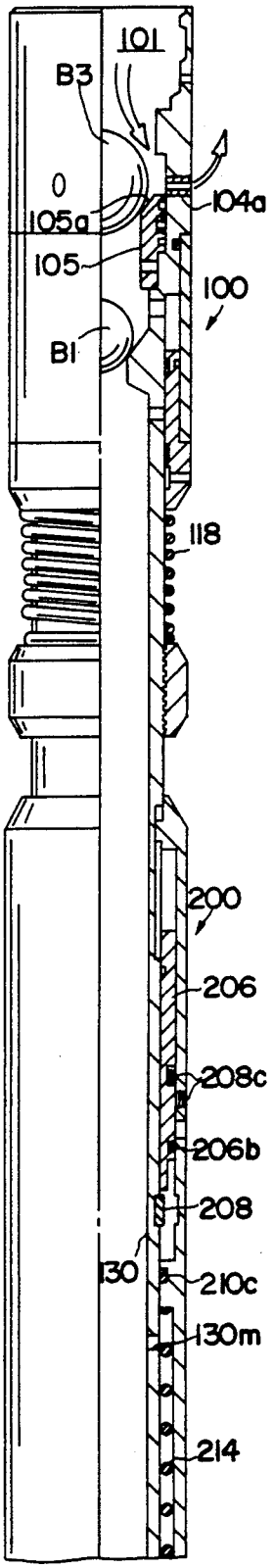
FIGS. 7A, 7B, and 7C collectively constitute a schematic vertical quarter sectional view of the well treatment apparatus showing the position of the components during the retrieval of the apparatus from the well while maintaining circulation.
Figure 7B:
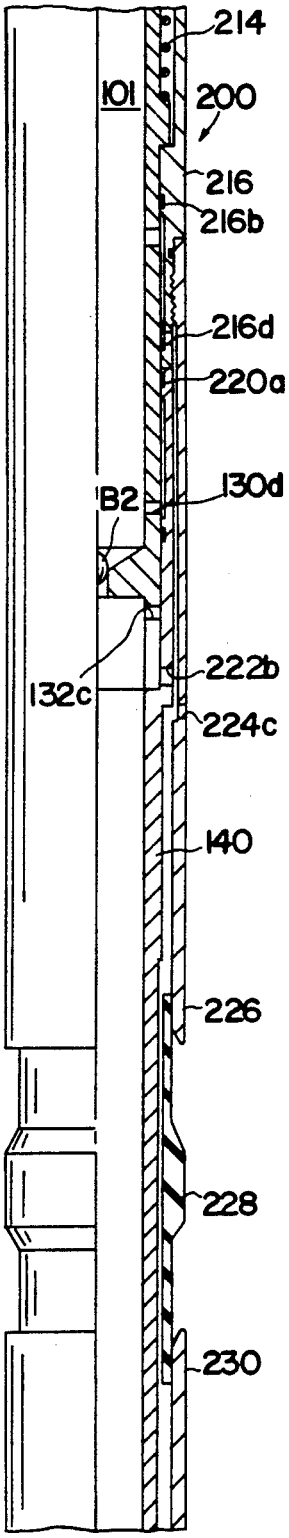
Figure 7C:
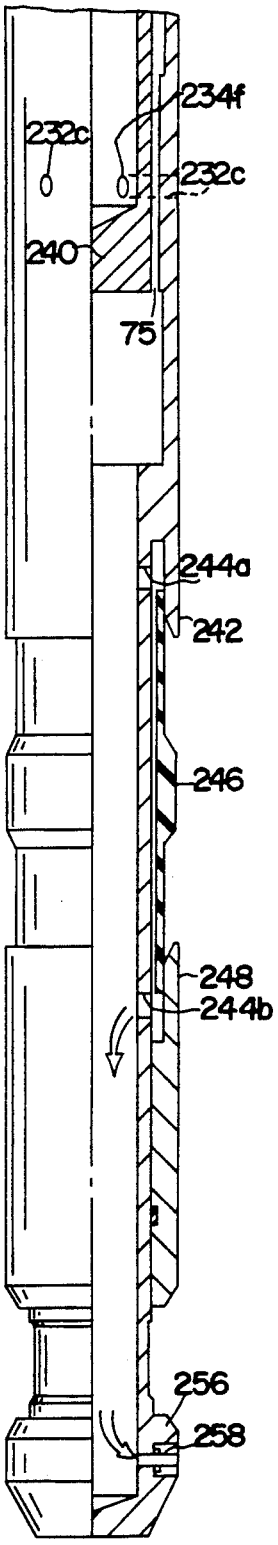

When the entire treatment operation has been completed, and it is desired to withdraw the treatment apparatus from the well through the previously existing tubing string, the central tubular body assemblage 100 is returned to its inflate-deflate position and then the fluid pressure is substantially increased above the inflation, testing and treatment levels to affect a rupturing of the rupture disc 258 provided in the bottom end of the outer tubular body assemblage 200. This permits any trapped fluid within the deflated elastomeric packing elements to drain out of the bottom of the tool, thus facilitating passage of these elements through the pre-existing tubing string, as shown in FIGS. 7A–7C.

If it is desired to circulate fluid during the removal of the treatment apparatus, this may be accomplished by dropping a third ball B3 to seat on the uppermost valve seat 105a provided on the central tubular body assemblage 100 and applying a fluid pressure sufficient to affect the shearing of shear screws 104a holding the valve seat sleeve 105 in position. The shearing of these screws permits the valve seal sleeve to move downwardly and thus open a path to the well bore through the ports in the same plane as the shear screws, as shown in FIGS. 7A, 7B and 7C.

The advantages of a tool embodying this invention will be readily apparent to those skilled in the art. In the first place, the entire treatment apparatus may be inserted in the well bore through a pre-existing tubing string, such as production tubing. Circulation may be maintained while the treatment apparatus is being inserted in the well. The elastomeric packing elements are inflated and deflated at the same position of the central tubular body assemblage 100 relative to the outer tubular body assemblage 200. A simple upward movement of the central tubular body assemblage 100 against the bias of compression spring 214 affects the trapping of the inflation fluid pressure within the expanded elastomeric packing elements. During the expansion of the elastomeric packing elements, any fluid pressure developed in the well bore between such elements is drained into the well bore above the uppermost packing element, thus avoiding any undesirable build up of fluid pressure between the two expanded elastomeric packing elements. Spotting of the treatment fluid may be accomplished by increasing the fluid pressure to a level above that required for expanding the packing elements and thus affecting the upward movement of the locking piston 206. Such upward movement provides communication between the central passage 101 in the central tubular body assemblage 100 with the well bore above the uppermost packing element and permits all pressurizing or testing fluid contained in the fluid supply conduit to be pumped into this area of the well bore by the treatment fluid.

Subsequent downward movement of the central tubular body assemblage 100 is accomplished by the compressed spring 214, hence eliminating the need for any set down weight, which is a practical impossibility when using coiled tubing as the fluid supply conduit. The resulting engagement of locking segments 208 limits all subsequent axial movements of the inner tubular body assemblage between two fixed positions, eliminating guess work by the operator.

The treatment apparatus can not only be shifted to a variety of positions in the well bore but, when removal of the apparatus from the well bore is desired, the downward shifting of the central tubular body assemblage 100 by the compressed spring 214 to the inflate-deflate position and the application of a higher fluid pressure to the central passage in the central tubular body assemblage 100 affects the rupturing of rupture disc 258 to drain any remaining fluid from the deflated elastomeric packing elements prior to their passage through a preexisting tubing string. Thus, all of the disadvantages of the prior art apparatus have been completely eliminated through the method and apparatus of the aforedescribed fluid treatment tool.

It will be appreciated that the apparatus is easily converted from a device containing a circulation valve to one containing a fluid control valve upon dropping of a first ball on the ball seat after the apparatus is run into the well, as described, and prior to retrieval of the apparatus from its set condition, by dropping a second ball upon a ball seat positioned above the first ball seat, also as described.

It will also be appreciated that the apparatus, as designed, is easily resettable within the well, without requirement of retrieval to the top of the well.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. An inflatable well treatment tool suitable for insertion into a well through a well conduit disposed in a well bore, comprising:

a central tubular body assemblage connectable to a fluid supply conduit extending to the surface;

said central tubular body assemblage defining a central fluid passage communicating with the fluid supply conduit;

an outer tubular assemblage surrounding a medial portion of said central tubular body and cooperating therewith to define a generally annular fluid passage surrounding said central tubular body assemblage;

resilient means urging said central tubular body assemblage downwardly relative to said outer tubular assemblage to a run-in position;

said outer tubular assemblage including at least one annular elastomeric means expandable by pressured inflation fluid supplied through said annular fluid passage into sealing engagement with the well bore;

inflate port means in the lower portion of said central tubular body assemblage connecting said central fluid passage to said annular fluid passage;

said central tubular body assemblage having a first radial port in its upper end communicating with the well bore, whereby circulation may be maintained during run-in;

a valve seat surrounding said central fluid passage adjacent said first radial port;

a second radial port in said central tubular body assemblage below said valve seat;

an annular piston sealably surrounding the upper end of said central tubular body assemblage and responsive to fluid pressure in said central fluid passage for axially shiftable movement relative to said first and second radial ports between a first position permitting circulation and a second position bypassing said valve seat; and a valve head seatable on said valve seat to permit buildup of fluid pressure in said central fluid passage to shift said annular piston to said second position and supply pressurized fluid to expand said annular elastomeric means into sealing engagement with the well bore.

2. The apparatus of claim 1 further comprising a spring urging said piston to said first position.

3. The apparatus of claim 1 further comprising a first annular seal means sealingly mounted between said central tubular body assemblage and said outer tubular body assemblage adjacent said inflate port means; whereby upward movement of said central tubular body assemblage relative to said outer tubular body assemblage traps the pressured fluid within said annular elastomeric means.

4. The apparatus of claim 3 further comprising means for limiting said upward movement of said central tubular body assemblage to a preselected distance.

5. The apparatus of claim 4 further comprising:

a check valve in said central fluid conduit below said inflate port means to block downward fluid flow in said central fluid conduit;

third and fourth radial ports in said central tubular body assemblage respectively disposed above and below said check valve;

second annular seal means between said third and fourth radial ports blocking fluid communication between said third and fourth radial ports in said run-in position;

the axial location of said third and fourth radial ports being selected to move the lowermost port past said second annular seal means when said central tubular body assemblage is moved upwardly said preselected distance, thereby bypassing said check valve and permitting fluid flow down said central fluid conduit to a location below said annular elastomeric element; and a treatment port means at said location connecting said central fluid passage with the well bore to supply pressurized fluid thereto.

6. The apparatus of claim 5 further comprising:

a fifth radial port in said central tubular body assemblage above said inflate port means;

a radial passage in said outer tubular body above said fifth radial port communicating with the well bore;

a piston sleeve positioned between said central tubular body assemblage and said outer tubular body assemblage preventing fluid communication between said fifth radial port and said radial passage in the run-in and inflation operations of said apparatus; and means for retaining said piston sleeve in said communication preventing position until said central tubular body assemblage has been raised said preselected distance and said fluid pressure in said central fluid conduit has been increased to a predetermined level, causing said piston sleeve to shift to open communication between said fifth radial port and said radial passage, whereby fluid in the fluid supply conduit may be displaced into the well bore by supplying pressurized treatment fluid through the fluid supply conduit.

7. The apparatus of claim 6 further comprising means responsive to said predetermined level of fluid pressure in said central fluid conduit for limiting subsequent upward movements of said central tubular body to less than said preselected distance, thereby preventing any further communication between said fifth radial port and said radial passage.

8. The apparatus of claim 4 further comprising:

a third radial port in said central tubular body assemblage above said inflate port means;

a radial passage in said outer tubular body assemblage above said third port and communicating with the well bore; and annular seal means between said third port and said radial passage preventing communication therebetween until said central tubular body assemblage is raised said preselected distance relative to said outer tubular body assemblage, whereby the elevation of said central tubular body assemblage to said preselected distance permits the existing fluid in the fluid supply conduit to be discharged into the well bore by pressurized treatment fluid.

9. The apparatus of claim 8 further comprising means responsive to said predetermined level of fluid pressure in said central fluid conduit for limiting subsequent upward movements of said central tubular body assemblage to less than said preselected distance, thereby preventing any further communication between said third port and said radial passage.

10. An inflatable well treatment tool suitable for insertion into a well through a well conduit disposed in a well bore, comprising:

a central tubular body assemblage connectable to a fluid supply conduit extending to the surface;

said central tubular body assemblage defining a central fluid passage communicating with the fluid supply conduit;

an outer tubular body assemblage surrounding a medial portion of said central tubular body assemblage and cooperating therewith to define a generally annular fluid passage surrounding said central tubular body assemblage;

resilient means urging said central tubular body assemblage downwardly relative to said outer tubular body assemblage to a run-in position;

said outer tubular body assemblage including at least one annular elastomeric means expandable by pressure inflation fluid supplied through said annular fluid passage into sealing engagement with the well bore;

inflate port means in the lower portion of said central tubular body assemblage connecting said central fluid passage to said annular fluid passage whereby pressured fluid supplied from the supply conduit will expand said annular elastomeric element into sealing engagement with the well bore; and a first annular seal means sealingly mounted between said central tubular body assemblage and said outer tubular body assemblage adjacent said radial port means, whereby upward movement of said central tubular body assemblage relative to said outer tubular assemblage traps the pressured fluid within said annular elastomeric means until said central tubular body assemblage is returned to said run-in position by said resilient means.

11. The apparatus of claim 10 further comprising means for limiting said upward movement of said central tubular body assemblage to a preselected distance.

12. The apparatus of claim 11 further comprising:

a check valve in said central fluid conduit below said port means to block downward fluid flow in said central fluid conduit;

first and second radial ports in said central tubular body assemblage respectively disposed above and below said check valve;

second annular seal means between said first and second radial ports blocking fluid communication between said first and second radial ports in said run-in position;

the axial location of said first and second radial ports being selected to move the lowermost port past said second annular seal means when said central tubular body assemblage is moved upwardly said preselected distance, thereby bypassing said check valve and permitting fluid flow down said central fluid conduit to a location below said annular elastomeric element; and treatment port means at said location connecting said central fluid passage with the well bore to supply pressurized fluid thereto.

13. The apparatus of claim 11 further comprising:

a radial port in said central tubular body assemblage above said inflate port means;

a radial passage in said outer tubular body assemblage above said radial port communicating with the well bore;

a piston sleeve positioned between said central tubular body assemblage and said outer tubular body assemblage preventing fluid communication between said radial port and said radial passage in the run-in and inflation operations of said apparatus; and means for retaining said piston sleeve in said communication preventing position until said central tubular body assemblage has been raised said preselected distance and said fluid pressure in said central fluid conduit has been increased to a predetermined level, causing said piston sleeve to shift to open communication between said radial port and said radial passage, whereby fluid in the fluid supply conduit may be displaced into the well bore by supplying pressurized treatment fluid through the fluid supply conduit.

14. The apparatus of claim 13 further comprising means responsive to said predetermined level of fluid pressure in said central fluid conduit for limiting subsequent upward movements of said central tubular assemblage body to less than said preselected distance, thereby preventing any further communication between said radial port and said radial passage.

15. The apparatus of claim 11 further comprising:

a radial port in said central tubular body assemblage above said port means;

a radial passage in said outer tubular body assemblage above said radial port and communicating with the well bore; and annular seal means between said radial port and said radial passage preventing communication therebetween until said central tubular body assemblage is raised said preselected distance relative to said outer tubular body assemblage, whereby the elevation of said central tubular body assemblage to said preselected distance permits the existing fluid in the fluid supply conduit to be discharged into the well bore by pressurized treatment fluid.

16. The apparatus of claims 1 or 10 further comprising means in the uppermost portion of said central tubular body assemblage responsive to a fluid pressure in said central fluid conduit greater than any of the inflation pressure, testing pressure or treatment pressure, for sealing off fluid flow downwardly through said central fluid conduit and establishing a circulation fluid path to the well bore operable during removal of the apparatus from the well.

17. The apparatus of claims 1 or 10 further comprising vent port means in said central and outer tubular body assemblages communicating with the annular elastomeric means during inflation of said annular elastomeric means to vent any excess pressure below the inflated annular elastomeric means to the well bore above the inflated annular elastomeric means.

18. The apparatus of claims 1 or 10 further comprising means disposed in the wall of said central tubular body assemblage to drain fluid from the apparatus for removal from the well, said means being responsive to a predetermined fluid pressure in excess of said inflation fluid pressure.

19. The apparatus of claims 1, 2, 3, 4, 8, 9, 10 or 11 further comprising a plurality of annular inflatable elastomeric means forming the lower end of said outer tubular body assemblage, and being inflated by pressured fluid in said generally annular fluid conduit into sealing engagement with the well bore.

20. The apparatus of claims 5, 6, 7, 12, 13, 14 or 15 further comprising a plurality of annular inflatable elastomeric means forming the lower end of said outer tubular body assemblage, and being inflated by pressured fluid in said generally annular fluid conduit into sealing, engagement with the well bore, said treatment port communicating with the well bore intermediate the inflated annular elastomeric elements, thereby permitting the application of fluid pressure followed by the application of treatment fluid.

21. The method of treatment of a selected portion of a subterranean well bore comprising the steps of:

(1) inserting in the well bore by a fluid supply conduit a vertically spaced pair of inflatable packing elements in straddling relationship to the well bore portion to be treated, said inflatable packing elements forming part of an outer tubular assemblage surrounding a central tubular assemblage connected to the fluid supply conduit and vertically movable through a limited distance relative to the central tubular assemblage; said central tubular assemblage defining a central fluid passage and said outer tubular assemblage defining a generally annular outer fluid passage surrounding said central tubular assemblage;

(2) circulating fluid during run-in between the upper end of the central tubular assemblage and the well bore;

(3) dropping a ball on a seat provided in the upper end of the central fluid conduit to stop circulation;

(4) increasing fluid pressure in the fluid supply conduit to activate a valve to permit fluid supplied to said central fluid passage to bypass the ball and flow downwardly through said central fluid passage;

(5) providing a port between said central fluid passage and said outer fluid passage to supply pressured fluid to both said inflatable packing elements to inflate same into sealing engagement with the well bore;

(6) trapping pressured fluid in said inflatable elements by moving said central tubular assemblage upwardly a preselected distance against the bias of a spring; and (7) opening a fluid passage between said central fluid passage and the well bore portion intermediate said inflated packing elements by said upward movement to supply pressurized testing or treatment fluid to said well bore portion.

22. The method of claim 21 further comprising the steps of:

providing a rupture disc in the lower portions of either said central fluid passage or said outer fluid passage; and increasing the pressure of fluid supplied through said fluid supply conduit to rupture said rupture disc and permit fluid to drain from said inflatable packing elements prior to removal from the well bore.

23. The method of claim 21 further comprising the steps of:

subsequent to inflation of said inflatable packing elements and in response to said preselected upward movement of said central tubular assemblage, placing said outer fluid passage above said inflatable packing elements in fluid communication with a valving chamber having a port communicating with the well bore and a piston valve shearably secured in said valving chamber in a position blocking fluid flow into the well bore;

increasing the pressure of fluid supplied by the supply conduit to a level sufficient to shearably release and move said valve piston to a position permitting fluid flow from said inner fluid passage to the well bore through said port, whereby fluid in said supply conduit may be pumped into the well bore by the introduction of pressurized treatment fluid in the supply conduit; and then closing said port by downward movement of said central tubular assemblage.

24. The method of claim 23 comprising the step of limiting subsequent upward movements of said central tubular assemblage to a distance that will trap pressured fluid in said inflatable packing elements but will not affect communication between said inner fluid passage and said valving chamber.

25. The method of claim 23 further comprising the step of engaging a spring biased, contractible abutment with said central tubular assemblage when said central tubular assemblage moves downwardly to limit subsequent upward movements of said central tubular assemblage to a distance that will trap pressured fluid in said inflatable packing elements but will not affect communication between said outer fluid passage and said valving chamber.

26. The method of claim 21 further comprising the steps of:

opposing said upward movement of said central tubular assemblage by a spring;

deflating the inflatable packing elements by releasing the upward force on said central tubular assemblage whereby said spring returns the central tubular assemblage to its run-in position relative to said outer tubular assemblage.

27. The method of claim 26 further comprising the steps of:

providing a rupture disc in the lower portions of either said central fluid passage or said outer fluid passage; and increasing the pressure of fluid supplied through said fluid supply conduit to rupture said rupture disc and permit fluid to drain from said inflatable packing elements prior to removal from the well bore.

28. The method of claim 26 further comprising the step of increasing the fluid pressure supplied through the supply conduit to a predetermined level higher than that utilized for inflation, testing or treatment operations and opening a valve in the uppermost portions of said central tubular assemblage to provide circulation during removal from the well bore.

29. The method of treatment of a selected portion of a subterranean well bore comprising the steps of:

(1) inserting in the well bore by a fluid supply conduit a vertically spaced pair of inflatable packing elements in straddling relationship to the well bore portion to be treated, said inflatable packing elements forming part of an outer tubular assemblage surrounding a central tubular assemblage connected to the fluid supply conduit and vertically movable through a limited distance relative to the outer tubular assemblage; said central tubular assemblage defining a central fluid passage and said outer tubular assemblage defining a generally annular outer fluid passage surrounding said central tubular assemblage;

(2) providing a port between said central fluid passage and said outer fluid passage to supply pressured fluid to both said inflatable packing elements to inflate same into sealing engagement with the well bore;

(3) trapping pressure fluid in said inflatable elements by moving said central tubular assemblage upwardly a preselected distance against the bias of a spring;

(4) opening a fluid passage between said central fluid passage and the well bore portion intermediate said inflated packing elements by said upward movement to supply pressurized testing or treatment fluid to said well bore position; and deflating the inflatable packing elements by releasing the upward force on said central tubular assemblage to permit said spring to return said central tubular assemblage to its run-in position relative to said outer tubular body assemblage.

30. The method of claim 29 further comprising the steps of:

providing a rupture disc in the lower portions of either said central fluid passage or said outer fluid passage; and increasing the pressure fluid supplied through said fluid supply conduit to rupture said rupture disc and permit fluid to drain from said inflatable packing elements prior to removal from the well bore.

31. The method of claim 29 further comprising the steps of:

subsequent to inflation of said inflatable packing elements and in response to said preselected upward movement of said central tubular assemblage, placing said outer fluid passage above said inflatable packing elements in fluid communication with a valving chamber having a port communicating with the well bore, and a piston valve shearably secured in said valving chamber in a position blocking fluid flow into the well bore;

increasing the pressure of fluid supplied by the supply conduit to a level sufficient to shearably release and move said valve piston to a position permitting fluid flow from said inner fluid passage to the well bore through said port, whereby fluid in said supply conduit may be pumped into the well bore by the introduction of pressurized treatment fluid in the supply conduit; and then closing said port by downward movement of said central tubular body assemblage.

32. The method of claim 31 comprising the step of limiting subsequent upward movements of said central tubular assemblage to a distance that will trap pressured fluid in said inflatable packing elements but will not affect communication between said outer fluid passage and said valving chamber.

33. The method of claim 31 further comprising the step of engaging a spring biased, contractible abutment with said central tubular assemblage when said central tubular assemblage moves downwardly to limit subsequent upward movements of said central tubular assemblage to a distance that will trap pressured fluid in said inflatable packing elements but will not affect communication between said outer fluid passage and said valving chamber.

34. The method of claim 29 further comprising the steps of:

opposing said upward movement of said central tubular assemblage by a spring;

deflating the inflatable packing elements by releasing the upward force on said central tubular assemblage, whereby said spring returns the central tubular assemblage to its run-in position relative to said outer tubular body assemblage.

35. The method of claim 34 further comprising the steps of:

providing a rupture disc in the lower portions of either said central fluid passage or said outer fluid passage; and increasing the pressure of fluid supplied through said fluid supply conduit to rupture said rupture disc and permit fluid to drain from said inflatable packing elements prior to removal from the well bore.

36. The method of claim 34 further comprising the step of increasing the fluid pressure supplied through the supply conduit to a predetermined level higher than that utilized for inflation, testing or treatment operations and opening a valve in the uppermost portions of said central tubular assemblage to provide circulation during removal from the well bore.

37. The method of claims 21 or 29 further comprising the step of venting the well bore portion between the two inflatable elements to the well bore above the uppermost inflatable element while inflation fluid is being supplied to the inflatable elements, thereby preventing a build up in pressure of fluid trapped between the inflatable elements.

38. A well bore treatment apparatus comprising:

a central tubular body assemblage defining a central fluid passage having a closed bottom end;

means on the top end of said central tubular body assemblage for connection to a fluid supply conduit extending to the well surface;

an outer tubular body assemblage surrounding a lower portion of said central tubular body assemblage;

said outer tubular body assemblage including a pair of vertically spaced inflatable packing elements;

a first valve means in the upper portion of said central tubular assemblage for diverting fluid supplied from the supply conduit into the well bore for circulation during run-in of the apparatus;

means for supplying pressured fluid from said central fluid passage to inflate said packing elements into sealing engagement with a selected portion of the well bore;

a second valve means in the upper portion of said central tubular assemblage for diverting fluid supplied from the supply conduit into the well bore for circulation during retrieval of the apparatus;

said first and second valve means respectively comprising upper and lower ball seats surrounding said central fluid passage;

a first ball dropped on said lower ball seat after run-in of said apparatus;

a second ball dropped on said upper ball seat prior to retrieval of said apparatus;

said first valve means further comprising three vertically spaced radial ports in said central tubular body assemblage;

the upper one of said radial ports being above said lower valve seat; and a piston sleeve valve shiftable by fluid pressure supplied through the supply conduit to shift said piston sleeve valve from a first position closing the intermediate port and opening the lowermost port for circulation, to a second position closing the lowermost port and opening said intermediate said port to provide a fluid bypass around said lower ball seat.

39. The apparatus of claim 38 wherein said upper annular ball seat is formed on a sleeve slidably mounted in said central fluid passage;

a fourth radial port in said central tubular body assemblage adjacent said sleeve; and shearable means for securing said sleeve in sealing relation to said fourth radial support.

40. A well bore treatment apparatus comprising:

a central tubular body assemblage defining a central fluid passage having a closed bottom end;

means on the top end of said central tubular body assemblage for connection to a fluid supply conduit extending to the well surface;

an outer tubular assemblage surrounding the lower portions of said central tubular body assemblage;

said outer tubular assemblage including a pair of vertically spaced, inflatable packing elements;

said outer tubular assemblage further defining a generally annular fluid passage surrounding said central tubular body assemblage and communicable with the interior of said inflatable packing elements;

valve means in a medial portion of said central fluid passage blocking fluid flow;

first port means communicating between an upper portion of said central fluid passageway and said generally annular fluid passage, whereby pressurized fluid supplied to the top of said central fluid passage affects expansion of said inflatable packing elements; and sealing means disposed in said annular fluid passage adjacent and above said first port means, whereby upward movement of said central tubular body assemblage after expansion of said inflatable packing elements, traps the applied fluid pressure in said inflated packing elements.

41. The apparatus of claim 40 further comprising resilient means opposing upward movement of said central tubular body assemblage relative to said outer tubular body assemblage.

42. The apparatus of claim 40 further comprising:

second port means communicating between the well bore portion intermediate said inflatable packing elements and said central fluid passage below said valve means;

bypass ports straddling said valve means; and a seal blocking communication between said bypass ports in the inflate position of said central tubular body assemblage, whereby said upward movement of said central tubular assemblage bypasses said valve means to permit testing or treatment fluid to be supplied to said well bore portion.

43. The apparatus of claim 40 further comprising check valve means disposed in said central fluid passage and biased to a closed position; fluid passage means communicating between said check valve means and said annular piston, whereby fluid displaced by a biasing of said annular piston to said first position opens said check valve means.

44. An inflatable well treatment tool suitable for insertion into a well through a well conduit disposed in the wellbore, comprising:

a central tubular body assembly connectable to a fluid supply conduit extending to the surface;

said central tubular body assembly defining a central fluid passage through said well conduit;

an outer tubular assembly surrounding a medial portion of said central tubular body assembly and cooperating therewith to define a generally annular fluid passage surrounding said central tubular body assembly;

said outer tubular assembly including at least one annular elastomeric means expandable by pressured inflation fluid supplied through said annular fluid passage into sealing engagement with the wellbore;

inflate port means in the lower portion of said central tubular body assembly connecting said central fluid passage to said annular fluid passage;

an annular piston sealably surrounding the upper end of said central tubular body assembly and responsive to fluid pressure in said central fluid passage for axially shiftable movement between a first position and a second position; and means responsive to movement of said annular piston from said first position to said second position to supply fluid pressure in said central fluid passage to said inflate port means.

45. The apparatus of claim 44 further comprising biasing means urging said piston to said first position.

* * * * *